United States Patent [19]

Inoue et al.

[11] Patent Number: 4,954,427

[45] **Date of Patent: * Sep. 4, 1990**

[54] PROCESS FOR THE FORMATION OF DIRECT POSITIVE IMAGES

[75] Inventors: Noriyuki Inoue; Tetsuro Kojima; Tatsuo Heki; Shigeo Hirano, all of Minami Ashigara, Japan

[73] Assignee: Fuji Photo Film Co., Ltd., Kanagawa, Japan

[ * ] Notice: The portion of the term of this patent subsequent to Dec. 6, 2005 has been disclaimed.

[21] Appl. No.: 60,790

[22] Filed: Jun. 12, 1987

[30] Foreign Application Priority Data

Jun. 12, 1986 [JP] Japan ..... 61-136949

[51] Int. Cl.[5] ..... G03C 5/22; G03C 5/24

[52] U.S. Cl. ..... 430/409; 430/410; 430/98; 430/940

[58] Field of Search ..... 430/409, 410, 598, 940

[56] References Cited

U.S. PATENT DOCUMENTS

| | | | |
|---|---|---|---|
| 3,708,298 | 1/1973 | Vanreusel et al. | 430/378 |
| 3,733,198 | 5/1973 | Vanreusel et al. | 430/378 |
| 4,341,858 | 7/1982 | Chaffee et al. | 430/598 |
| 4,358,528 | 11/1982 | Takagi et al. | 430/598 |
| 4,481,285 | 11/1984 | Takagi et al. | 430/410 |
| 4,482,627 | 11/1984 | Takagi et al. | 430/410 |
| 4,629,678 | 12/1986 | Murai | 430/230 |
| 4,789,627 | 12/1988 | Inoue et al. | 430/406 |
| 4,801,520 | 1/1989 | Inoue et al. | 430/378 |

OTHER PUBLICATIONS

Copending Application Serial No. 07/067850, Inoue, "Process for Forming Direct-Positive Image", 6/30/87.

Research Disclosure 18246, Jun. 1979.

Patent Abstract of Japan, vol. 10, No. 15, Jan. 21, 1986.

*Primary Examiner*—Paul R. Michl

*Assistant Examiner*—Patrick A. Doody

*Attorney, Agent, or Firm*—Sughrue, Mion, Zinn, Macpeak & Seas

[57] ABSTRACT

A process for the formation of direct positive images comprising (1) imagewise exposing to light, a light-sensitive material comprising a photographic emulsion layer containing unfogged internal latent image type silver halide particles on at least one support, and (2) developing the light-sensitive material in the presence of a nucleating agent and at least one nucleation accelerator of general formula (I):

$$A-(Y)_nR]_m \qquad (I)$$

wherein A represents a group which is adsorbed by a silver halide; Y represents a divalent linkage group consisting of atoms or atomic groups selected from the group consisting of a hydrogen atom, a carbon atom, a nitrogen atom, an oxygen atom, and a sulfur atom; R represents an organic group containing at least one of a thioether group, an amino group, an ammonium group, an ether group, and a heterocyclic group; n represents an integer of 0 or 1; and m represents an integer of 1 or 2 to form direct positive images.

32 Claims, No Drawings

PROCESS FOR THE FORMATION OF DIRECT POSITIVE IMAGES

FIELD OF THE INVENTION

The present invention relates to a process for obtaining direct positive images by imagewise exposing a direct positive silver halide photographic material to light, and then developing the photographic material in the presence of a nucleating agent.

BACKGROUND OF THE INVENTION

Photographic processes for obtaining direct positive images without the use of a reversal processing step or negative film have been well known.

Methods for forming positive images by using conventional direct positive silver halide photographic materials are roughly divided into two types based upon their practical usefulness.

In one type, a silver halide emulsion which has previously been fogged is used. Solarization or the Herschel effect is used to destroy the fogged nucleus (latent image) of the exposed portions so that direct positive images are obtained after development.

In the other type, an unfogged internal latent image type silver halide emulsion is used. The internal latent image type silver halide emulsion which has been exposed to light is subjected to surface development after or while being fogged so that direct positive images are obtained.

The term "internal latent image type silver halide photographic emulsion" as described above means a photographic emulsion of silver halide grain which contains a light-sensitive nucleus mainly in the inside thereof so that a latent image is formed mainly in the inside thereof by being exposed to light.

The latter silver halide emulsion type generally provides a higher sensitivity than the former and is therefore suitable for applications requiring a high sensitivity. The present invention relates to the latter silver halide emulsion type.

In the art, various methods to form direct positive images have been heretofore known. Main examples of such methods include those described in U.S. Pat. Nos. 2,592,250, 2,466,957, 2,497,875, 2,588,982, 3,317,322 (2,497,875), 3,761,266, 3,761,276 and 3,796,577, and British Patent Nos. 1,151,363 and 1,150,553 (1,011,062).

With these known methods, a relatively high sensitivity direct positive type photographic light-sensitive material can be prepared.

The details of the mechanism of formation of direct positive images are described in "The Theory of the Photographic Process" (edited by T. H. James, pp. 182–193, Chapter 7, 4th Edition) and U.S. Pat. No. 3,761,276.

More particularly, the mechanism is believed to be as follows. A so-called internal latent image (positive hole) is produced in the inside of silver halide when the first imagewise exposure to light is effected. Such a positive hole causes a reduction in surface sensitivity. In this manner, fogged nuclei are selectively produced only on the surface of the unexposed silver halide grains. When an ordinary so-called surface development is then effected, a photographic image (direct positive image) is formed.

As means for selectively forming fogged nuclei as described above, there have been known a process which comprises subjecting the entire surface of the light sensitive layer to a second exposure to light, i.e., a so-called "light fogging process" (as described in British Patent No. 1,151,363) and a process which comprises using a nucleating agent, i.e., a so-called "chemical fogging process". The latter process is described in, for example, Research Disclosure, No. 15162, Vol. 151, pp. 72–87 (Nov., 1976).

The formation of direct positive color images are generally accomplished by a process which comprises subjecting an internal latent image type silver halide material to surface color development after or while being fogged, and then subjecting the light-sensitive material to bleach, fixing (blix), and ordinary rinsing and/or stabilization.

In the conventional chemical fogging process, a compound which serves as a nucleating agent only at a high pH of 12 or more is used. Therefore, this fogging process is disadvantageous in that the developing agent is susceptible to deterioration due to aerial oxidation at such a high pH. This will result in a remarkable reduction in development activity. Furthermore, this fogging process allows only a low development speed and thus consumes a long processing time, especially when a developing solution of a low pH value is used. Even when the pH value is 12 or more, the development takes much time.

On the other hand, the light fogging process does not require such a high pH condition and thus can be advantageously applied for practical use. However, this fogging process is not advantageous for all of the various uses required in the photographic field. That is, since the light fogging process is based on the formation of fogged nuclei by photodecomposition of silver halide, different types and properties of silver halide used provide correct exposure illuminances and exposures. Therefore, the light fogging process is disadvantageous in that it is difficult to provide a constant property and requires a complicated and expensive developing apparatus. This fogging process is also disadvantageous in that it consumes a long development time.

Thus, both of the conventional fogging processes fail to provide stable, excellent direct positive images. As means for solving these problems some compounds which serve as nucleating agents have been proposed in Japanese Patent Application (OPI) No. 69613/77 (the term "OPI" as used herein refers to a "published unexamined Japanese patent application"), and U.S. Pat. Nos. 3,615,615 and 3,850,638. However, these nucleating agents are disadvantageous in that they act on silver halide or undergo decomposition during storage in the light-sensitive material before processing. This results in a reduction in the maximum image density after processing.

A process which comprises speeding up the development of the maximum image density by use of a hydroquinone derivative is described in U.S. Pat. No. 3,227,552. However, even with this process, a sufficiently high development speed cannot be provided, especially when a developing solution of a pH value of 12 or less is ued.

A process which comprises raising the maximum image density by incorporation of a mercapto compound containing a carboxylic acid group or sulfonic acid group is described in Japanese Patent Application (OPI) No. 170843/85. However, the incorporation of such a mercapto compound gives only a small effect.

A process which comprises processing a light-sensitive material with a processing solution (pH 12.0) containing a tetraazaindene compound in the presence of a nucleating agent to lower the minimum image density so that the formation of a re-reversal negative image is prevented is known (Japanese Patent Application (OPI) No. 134848/80). However, this process can provide neither a high maximum image density nor a high development speed.

A light-fogging process which comprises incorporating a triazoline-thione or tetrazoline-thione compound as a fog inhibitor in a light-sensitive material forming direct positive images thereof is described in Japanese Patent Publication No. 12709/70. However, this process, too, can provide neither a high maximum image density nor a high development speed.

Thus, there have been no processes for producing direct positive images having a high maximum image density and a low minimum image density in a short period of time.

In instant color photography (color material dispersion transfer process), an image can be obtained in a short period of time. However, this photography demands a higher development speed.

In general, a high sensitivity direct positive emulsion is more susceptible to generation of a re-reversal negative image at a high intensity exposure condition.

SUMMARY OF THE INVENTION

It is therefore an object of the present invention to provide a process for forming direct positive images having a high maximum image density and a low minimum image density in a rapid and stable manner by processing an unfogged internal latent image type silver halide material with a developing solution in the presence of a nucleating agent.

It is another object of the present invention to provide a process for forming direct positive images which are less susceptible to generation of re-reversal negative images at a high intensity exposure condition.

It is a further object of the present invention to provide a process for forming direct positive color images which are less susceptible to variation in the optimum value of the maximum image density and minimum image density and change in color reproducibility when the temperature and pH of the developing solution are varied.

It is a still further object of the present invention to provide a process for forming direct positive images which are less susceptible to variation in the optimum value of the maximum image density and minimum image density and change in gradation when the developing time is varied.

An additional object of the present invention is to provide a process for forming direct positive images which are less susceptible to a reduction in the maximum image density and an increase in the minimum image density due to prolonged storage of the light-sensitive material.

Still another object of the present invention is to provide a process for forming stable direct positive images which are less susceptible to deterioration due to aerial oxidation of the developing solution.

It is further object of the present invention to provide a process for forming direct positive color images which are less susceptible to change in color reproducibility due when the developing time is varied.

These and other objects of the present invention will become more apparent from the following detailed description and examples.

These objects of the present invention are accomplished by a process for the formation of direct positive images which comprises (1) imagewise exposing to light a light-sensitive material comprising at least one photographic emulsion layer containing unfogged internal latent image type silver halide grains on a support and (2) developing the light-sensitive material in the presence of a nucleating agent and at least one compound comprising a group which is adsorbed by silver halide, and an organic group containing at least one of a thioether group, an amino group, an ammonium group, an ether group, and a heterocyclic group as a nucleation accelerator to form direct positive images.

DETAILED DESCRIPTION OF THE INVENTION

The term "nucleating agent" as used herein means a substance which acts on an unfogged internal latent image type silver halide emulsion upon its surface development to form direct positive images.

The term "nucleation accelerator" as used herein means a substance which does not substantially act as the above-mentioned nucleating agent but, rather, acts to accelerate nucleation to increase the maximum density of direct positive images and/or reduce the development time required to provide a predetermined direct positive image density. Two or more of such nucleation accelerators may be used in combination.

The nucleation accelerator useful in the present invention is represented by general formula (I):

$$A\text{-}[(Y)_n R]_m \qquad (I)$$

wherein A represents a group which is adsorbed by a silver halide. Examples of such a group include those groups derived from compounds containing mercapto groups bonded to a heterocyclic ring, heterocyclic compounds capable of forming imino silver, and hydrocarbon compounds containing mercapto groups.

Examples of mercapto compounds bonded to a heterocyclic ring include substituted or unsubstituted mercaptoazoles such as 5-mercaptotetrazoles, 3-mercapto-1,2,4-triazoles, 2-mercaptoimidazoles, 2-mercapto-1,3,4-thiadiazoles, 5-mercapto-1,2,4-thiadiazoles, 2-mercapto-1,3,4-oxidiazoles, 2-mercapto-1,3,4-selenadiazoles, 2-mercaptooxazoles, 2-mercaptothiazoles, 2-mercaptobenzoxazoles, 2-mercaptobenzimidazoles, and 2-mercaptobenzothiazoles, and substituted or unsubstituted mercaptopyrimidines such as 2-mercaptopyrimidines.

Examples of the above-mentioned heterocyclic compounds capable of forming imino silver include substituted or unsubstituted indazoles, benzimidazoles, benzotriazoles, benzoxazoles, benzothiazoles, imidazoles, thiazoles, oxazoles, triazoles, tetrazoles, azaindenes, and indoles.

Examples of the above-mentioned hydrocarbon compounds containing mercapto groups include alkylmercaptans arylmercaptans, alkenylmercaptans, and aralkylmercaptans (preferably $C_{2-12}$), arylmercaptans (preferably $C_{6-12}$), alkenylmercaptans (preferably $C_{3-12}$), and aralkylmercaptans (preferably $C_{7-12}$).

Y represents a divalent linkage group comprising an atom or atomic group selected from the group consisting of a hydrogen atom, a carbon atom, a nitrogen atom, an oxygen atom, and a sulfur atom. Examples of such a divalent linkage group include:

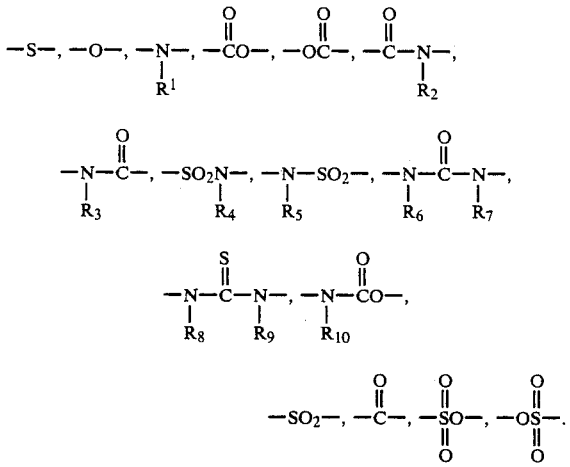

In the above formulae, $R_1$, $R_2$, $R_3$, $R_4$, $R_5$, $R_6$, $R_7$, $R_8$, $R_9$ and $R_{10}$ each represents a hydrogen atom, a substituted or unsubstituted alkyl group (preferably $C_{1-12}$, more preferably $C_{1-6}$) such as a methyl group, an ethyl group, a propyl group, and an n-butyl group, a substituted or unsubstituted or unsubstituted aryl group (preferably $C_{6-12}$, more preferably $C_{6-10}$) such a phenyl group and a 2-methylphenyl group, a substituted or unsubstituted alkenyl group (preferably $C_{3-12}$, more preferably $C_{3-6}$) such as a propenyl group, and a 1-methylvinyl group, or a substituted or unsubstituted aralkyl group (preferably $C_{7-12}$, more preferably $C_{7-10}$) such as a benzyl group, and a phenethyl group.

R represents an organic group containing at least one of a thioether group, an amino group (including salts thereof), an ammonium group, an ether group, or a heterocyclic group (including salts thereof).

Examples of the above-mentioned organic group include groups obtained by combining a group selected from substituted or unsubstituted aykyl groups (preferably $C_{1-12}$), alkenyl groups (preferably $C_{3-12}$), aralkyl groups (preferably $C_{7-12}$), and aryl groups (preferably $C_{6-12}$) with thioether groups, amino groups, ammonium groups, ether groups, or heterocyclic groups. Combinations of such organic groups may be used. Specific examples of such organic groups include a dimethylaminoethyl group, an aminoethyl group, a diethylaminoethyl group, a dibutylaminoethyl group, a dimethylaminopropyl hydrochloride group, a dimethylaminoethylthioethyl group, a 4-dimethylaminophenyl group, a 4-dimethylaminobenzyl group, a methylthioethyl group, an ethylthiopropyl group, a 4-methylthio-3-cyanophenyl group, a methylthiomethyl group, a trimethylammonioethyl group, a methoxyethyl group, a methoxyethoxyethoxyethyl group, a methoxyethylthioethyl group, a 3,4-dimethoxyphenyl group, a 3-chloro-4-methoxyphenyl group, a morpholinoethyl group, a 1-imidazolylethyl group, a morpholinoethylthioethyl group, a pyrrolidinoethyl group, a piperidinopropyl group, a 2-pyridylmethyl group, a 2-(1-imidazolyl)ethylthioethyl group, a pyrazolylethyl group, a triazolylethyl group, and a methoxyethoxyethoxyethoxycarbonylaminoethyl group.

In general formula (I), n represents an integer of 0 or 1, and m represents an integer of 1 or 2.

The nucleation accelerator useful in the present invention is also represented by general formula (II):

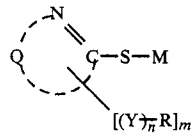

(II)

In general formula (II), Q represents an atomic group required to form a 5-membered or 6-membered heterocyclic ring comprising at least one atom selected from the group consisting of a carbon atom, a nitrogen atom, an oxygen atom, a sulfur atom and a selenium atom. The heterocyclic ring may be condensed with a carbocyclic aromatic ring or heterocyclic aromatic ring.

Examples of such a heterocyclic ring include tetrazoles, triazoles, imidazoles, thiadiazoles, oxadiazoles, selenadiazoles, oxazoles, thiazoles, benzoxazoles, benzothiazoles, benzimidazoles, and pyrimidines.

M represents a hydrogen atom, an alkali metal atom such as a sodium atom, and a potassium atom, an ammonium group such as a trimethylammonium group, and a dimethylbenzylammonium group; or group which undergoes cleavage under an alkaline condition to become an M=H group or an alkali metal atom such as an acetyl group, a cyanoethyl group, and a methanesulfonylethyl group. Of these, a hydrogen atom and an alkali metal (e.g., Na and K) are preferred.

The above heterocyclic rings may be substituted by nitro groups, halogen atoms such as a chlorine atom, and a bromine atom, mercapto groups, cyano groups, substituted or unsubstituted alkyl groups (preferably $C_{1-12}$) such as a methyl group, an ethyl group, a propyl group, a t-butyl group, and a cyanoethyl group, aryl groups (preferably $C_{6-12}$) such as a phenyl group, a 4-methanesulfonamidophenyl group, a 4-methylphenyl group, a 3,4-dichlorophenyl group, and a naphthyl group, alkenyl groups (preferably $C_{3-12}$) such as an allyl group, aralkyl groups (preferably $C_{7-12}$) such as a benzyl group, a 4-methylbenzyl group, and a phenethyl group, sulfonyl groups (preferably $C_{1-12}$) such as a methanesulfonyl group, an ethanesulfonyl group, and a p-toluenesulfonyl group, carbamoyl groups (preferably $C_{1-12}$) such as an unsubstituted carbamoyl group, a methylcarbamoyl group, and a phenylcarbamoyl group, sulfamoyl groups (preferably $C_{0-12}$) such as an unsubstituted sulfamoyl gruop, a methylsulfamoyl group, and a phenylsulfamoyl group, carbonamido groups (preferably $C_{1-12}$) such as an acetamido group, and a benzamido group, sulfonamido groups (preferably $C_{1-12}$) such as a methanesulfonamido group, a benzenesulfonamido group, and a p-toluenesulfonamido group, acyloxy groups (preferably $C_{1-12}$) such as an acetyloxy group, and a benzoylozy group, sulfonyloxy groups (preferably $C_{1-12}$) such as a methanesulfonyloxy group, ureido groups (preferably $C_{1-12}$) such as an unsubstituted ureido group, a methylureido group, an ethylureido group, and a phenylureido group, thioureido groups (preferably $C_{1-12}$) such as an unsubstituted thioureido group, and a methylthioureido group, acyl groups (preferably $C_{1-12}$) such as an acetyl group, and a benzoyl group, oxycarbonyl groups (preferably $C_{2-12}$) such as a methoxycarbonyl group, and a phenoxycarbonyl group, oxycarbonylamino groups (preferably $C_{2-12}$) such as a methoxycarbonylamino group, a phenoxycarbonylamino group, and a 2-ethylhexyloxycarbonylamino group, carboxylic acids (preferably $C_{1-12}$) or salts thereof, sulfonic acids or salts thereof, or hydroxyl groups. These heterocyclic rings preferably are not substituted by carboxylic acids or salts thereof, sulfonic acids or salts thereof, or hydroxyl groups in view of the effect of accelerating nucleation.

Preferred examples of the heterocyclic ring represented by Q include tetrazoles, triazoles, imidazoles, thiadiazoles, and oxadiazoles.

Y, R, m, and n are as defined in general formula (I).

The nucleation accelerator useful in the present invention is also represented by general formula (III):

(III)

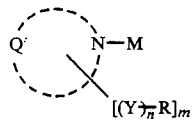

In general formula (III), Y, R, m, n and M are as defined in general formula (I), and Q' represents an atomic group required to form a 5-membered or 6-membered heterocyclic ring, preferably an atomic group required to form a 5-membered or 6-membered heterocyclic ring comprising at least one atom selected from the group consisting of a carbon atom, a nitrogen atom, an oxygen atom, a sulfur atom and a selenium atom. The heterocyclic ring may be condensed with a carbocyclic aromatic ring or heterocyclic aromatic ring.

Examples of the heterocyclic ring formed by Q include indazoles, benzimidazoles, benzotriazoles, benzoxazoles, benzothiazoles, imidazoles, thiazoles, oxazoles, triazoles, tetrazoles, tetraazaindenes, diazaindenes, pyrazoles, and indoles. Of these, benzotriazoles, indazoles, tetrazoles and tetraazaindenes are preferred.

Of the compounds represented by general formula (I), those represented by general formula (II) are preferred.

Specific examples of the compound of general formula (I) will be shown hereinafter, but the present invention should not be construed as being limited thereto.

1

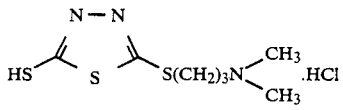

2

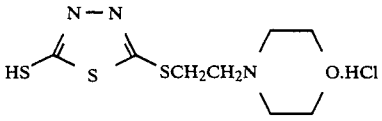

3

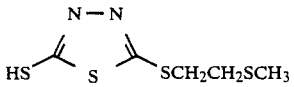

4

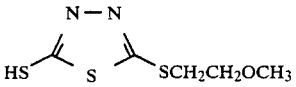

5

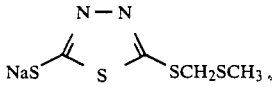

-continued

6

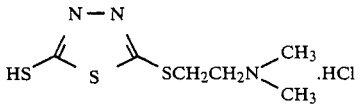

7

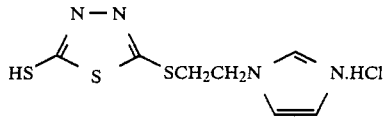

8

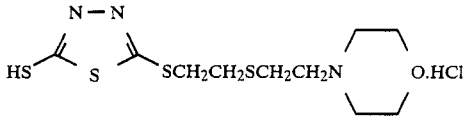

9

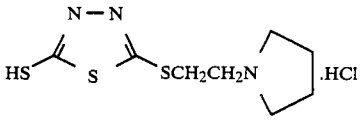

10

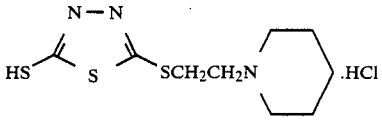

11

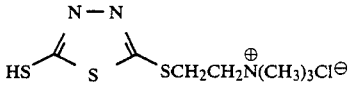

12

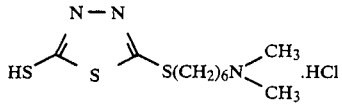

13

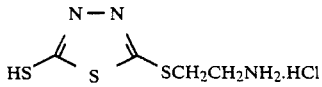

14

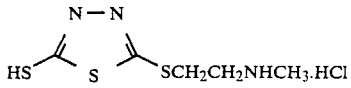

15

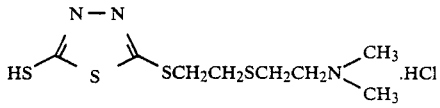

16

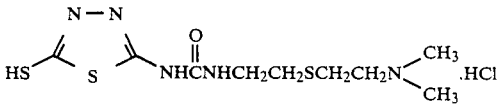

17

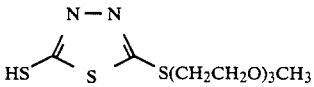

18

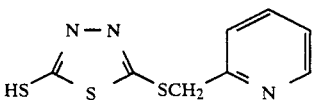

-continued
19
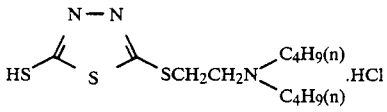
20
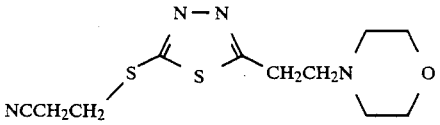
21
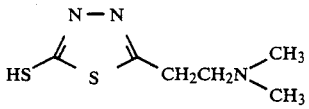
22
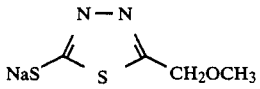
23
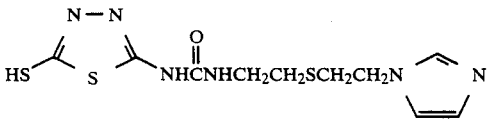
24
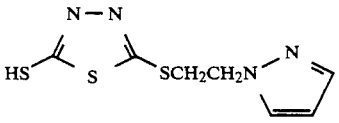
25
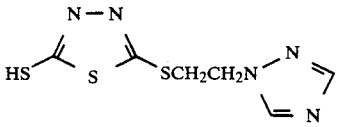
26
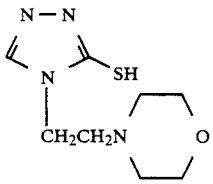
27
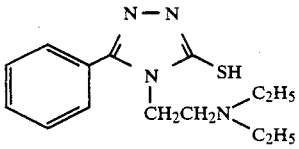
28
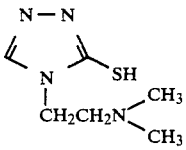
29
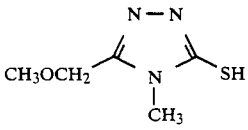
-continued
30
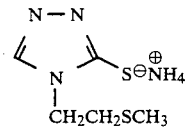
31
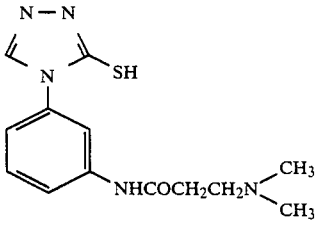
32
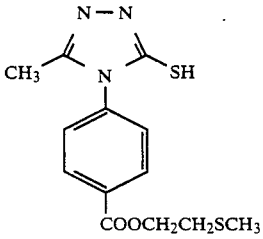
33
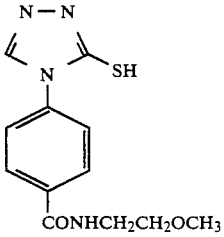
34
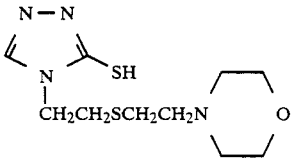
35
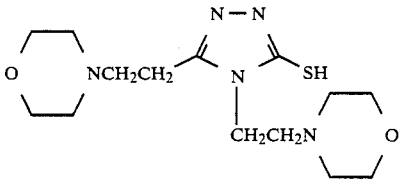
36
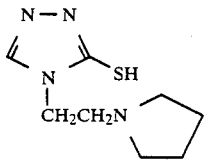
37
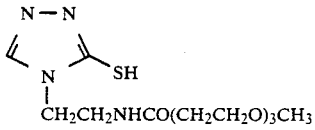

-continued
38
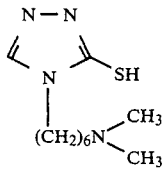
39
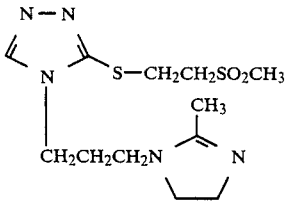
40
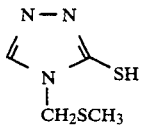
41
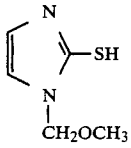
42
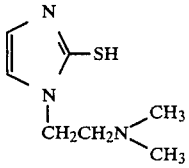
43
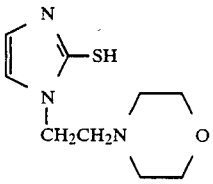
44
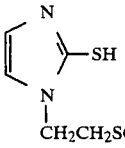
45
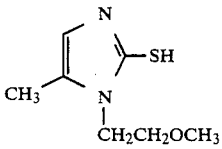
46
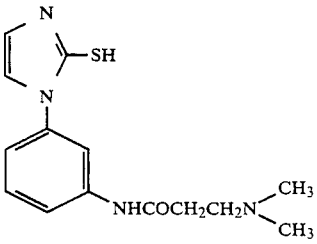
-continued
47
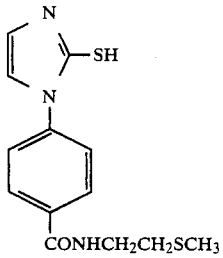
48
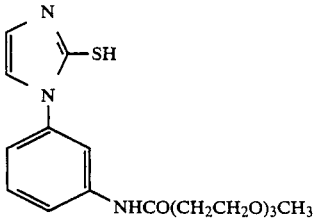
49
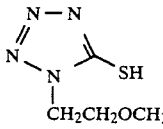
50
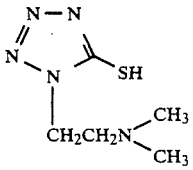
51
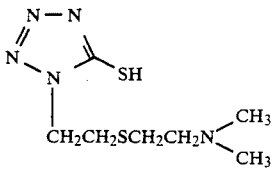
52
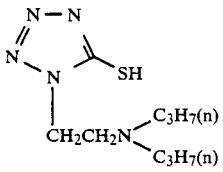
53
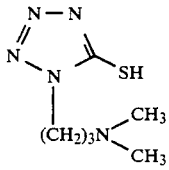
54
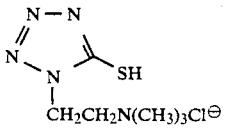

-continued
55
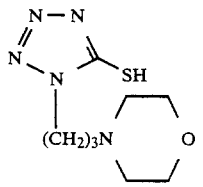
56
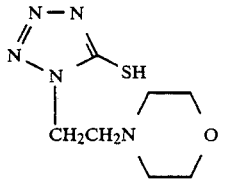
57
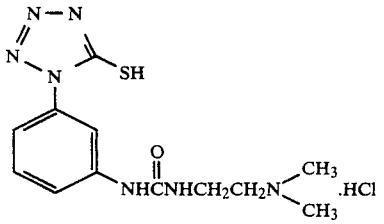
58
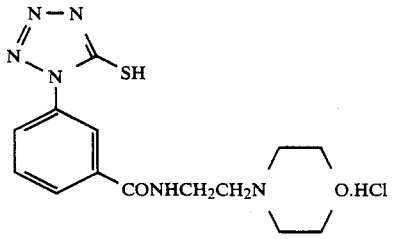
59
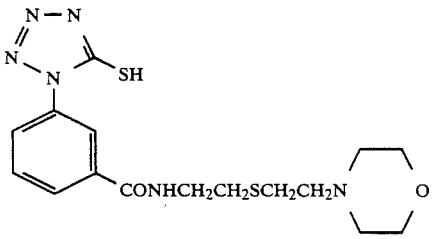
60
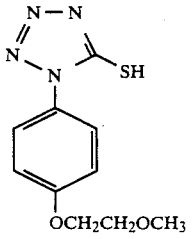
61
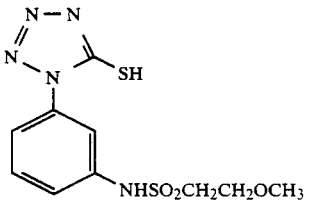
-continued
62
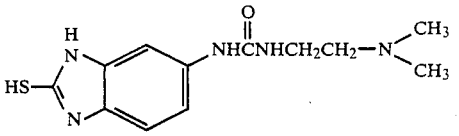
63
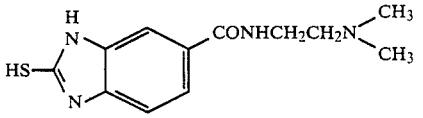
64
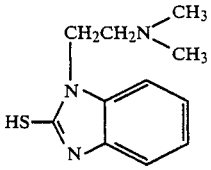
65
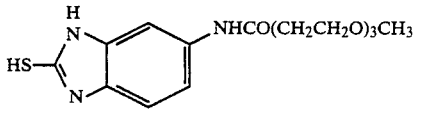
66
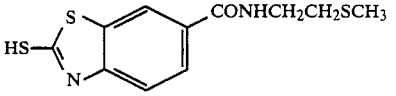
67
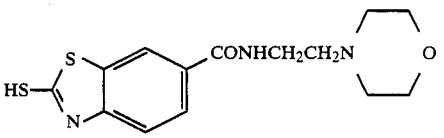
68
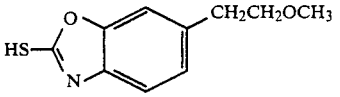
69
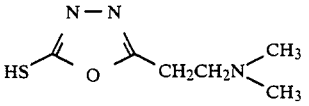
70
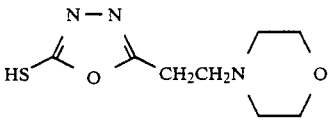
71
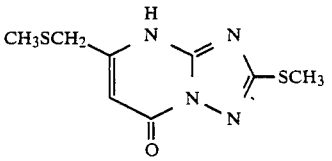
72
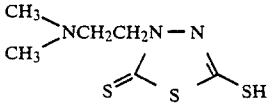
73
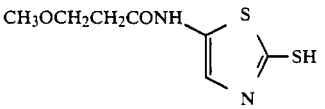

-continued
74
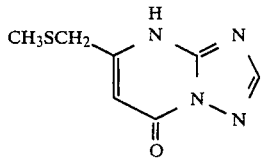
75
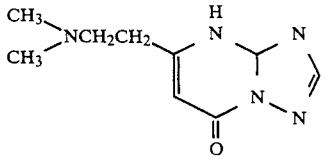
76
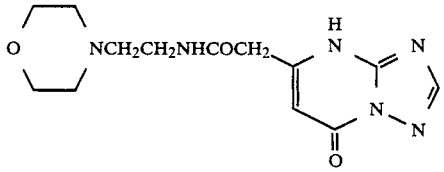
77
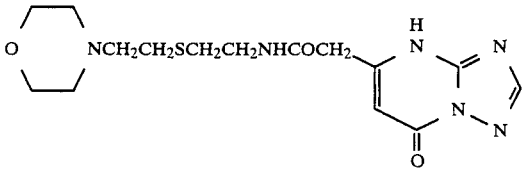
78
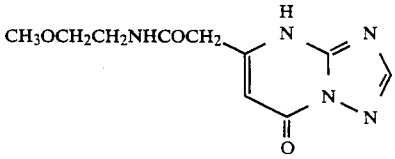
79
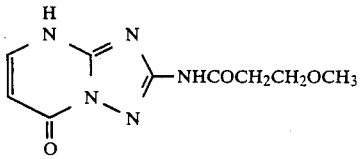
80
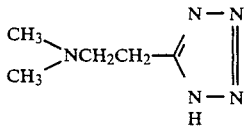
81
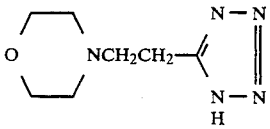
82
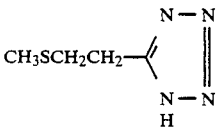
83
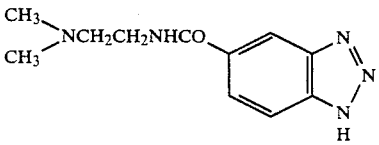
-continued
84
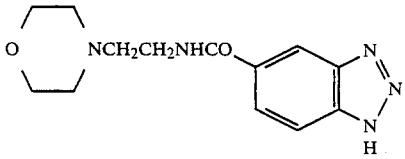
85
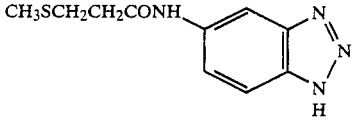
86
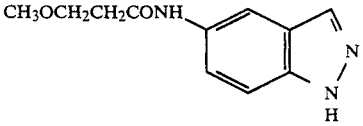
87
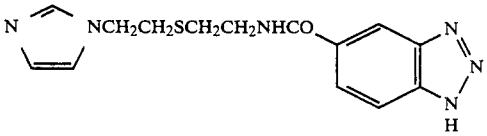
88
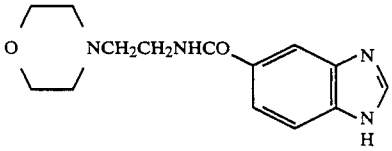
89
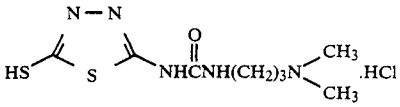
90
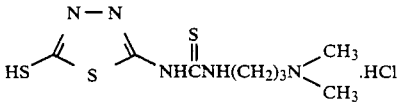
91
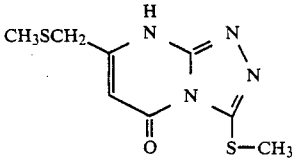
92
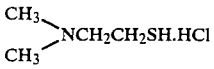
93
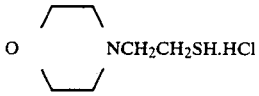
94
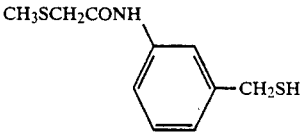

-continued

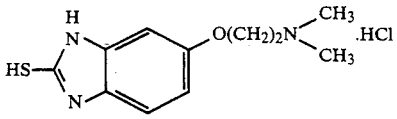

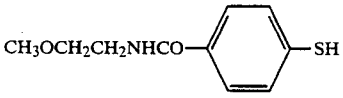

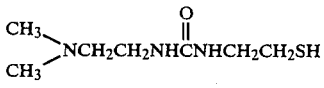

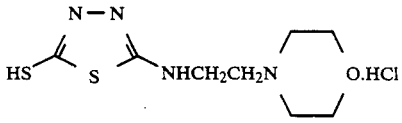

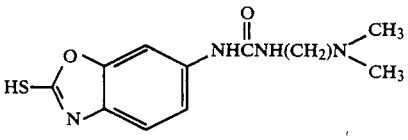

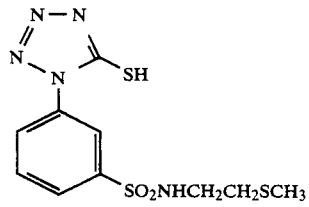

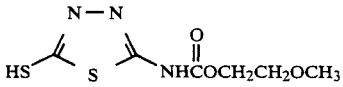

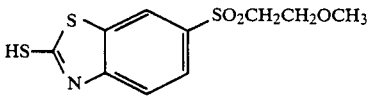

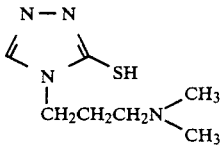

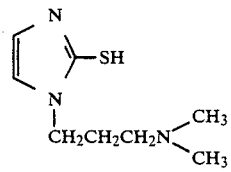

Of the above specific compounds, Compounds 1, 6, 12, 13, 15, 26, 28, 38, 42, 43, 50, 51, 53, 103 and 104 are preferred, with 1, 6, 12, 15, 28 and 103 being more preferred.

The synthesis of the nucleation accelerators which may be used in the present invention can be accomplished by any suitable methods as described in *Berichte der Deutschen Chemischen Gesellschaft* 28, 77 (1895), Japanese Patent Application (OPI) Nos. 37436/75 and 3231/76, U.S. Pat. Nos. 3,295,976 and 3,376,310, *Berichte der Deutschen Chemischen Gesellschaft*, 22, 568 (1889), and ibid., 29, 2483 (1896), *Journal of Chemical Society*, 1932, 1806, *Journal of The American Chemical Society*, 71, 4000 (1949), U.S. Pat. Nos. 2,585,388 and 2,541,924, *Advances in Heterocyclic Chemistry*, 9, 165 (1968), *Organic Synthesis*, IV, 569 (1963), *Journal of The American Chemical Society*, 45, 2390 (1923), *Chemische Berichte*, 9, 465 (1876), Japanese Patent Publication No. 28496/65, Japanese Patent Application (OPI) No. 89034/75, U.S. Pat. Nos. 3,106,467, 3,420,670, 2,271,229, 3,137,578, 3,148,066, 3,511,663, 3,060,028, 3,271,154, 3,251,691, 3,598,599 and 3,148,066, Japanese Patent Publication No. 4135/68, and U.S. Pat. Nos. 3,615,616, 3,420,664, 3,071,465, 2,444,605, 2,444,606, 2,444,607 and 2,935,404, or typical synthesis examples described hereinafter.

SYNTHESIS EXAMPLE 1

Synthesis of Compound (1)

7.5 g of 2,5-dimercapto-1,3,4-thiadiazole, 7.9 g of 3-dimethylaminopropyl chloride hydrochloride, and 4 g of pyridine were added to 60 ml of n-butanol. The admixture was heated under reflux for two hours. The reaction solution was cooled with ice. The resulting crystal was filtered off. The crystal was then recrystallized from ethanol. Yield: 11 g, m.p. 149°-152° C.

SYNTHESIS EXAMPLE 2

Synthesis of Compound (13)

7.5 g of 2,5-dimercapto-1,3,4-thiadiazole, 5.8 g of 2-aminoethyl chloride hydrochloride, and 4 g of pyridine were added to 60 ml of n-butanol. The admixture was heated under reflux for two hours. The reaction solution was cooled with ice. The resulting crystal was filtered off. The crystal was recrystallized from a 1:1 (v/v) mixture of methanol and water. Yield: 7.1 g, m.p. 228°-229° C. (decomposition)

SYNTHESIS EXAMPLE 3

Synthesis of Compound (6)

7.5 g of 2,5-dimercapto-1,3,4-thiadiazole, 7.3 g of 2-dimethylaminopropyl chloride hydrochloride, and 4 g of pyridine were added to 60 ml of n-butanol. The admixture was heated under reflux for two hours. The reaction solution was cooled with ice. The resulting crystal was filtered off. The crystal was recrystallized from ethanol. Yield: 7.9 g, m.p. 161°-163° C.

SYNTHESIS EXAMPLE 4

Synthesis of Compound (7)

15.0 g of 2,5-dimercapto-1,3,4-thiadiazole, 20.0 g of 1-(2-chloroethyl)imidazole hydrochloride, and 9.5 g of pyridine were added to 100 ml of acetonitrile. The admixture was heated under reflux for 4 hours. After the reaction was completed, the reaction solution was cooled. The resulting crystal was filtered off. The crystal was recrystallized from a mixed solvent of dimethylformamide and methanol (1:5 v/v) to obtain the Compound (7). Yield: 11.2 g, m.p. 226°-228° C.

SYNTHESIS EXAMPLE 5

Synthesis of Compound (89)

200 ml of acetonitrile was added to 12.7 g of 2-mercapto-5-phenoxycarbonylamino-1,3,4-thiadiazole. 6.2 g of 3-N,N-dimethylaminopropylamine was added dropwise to the admixture at room temperature. The admixture was then heated with stirring at a temperature of 50° C. for 1.5 hours. The resulting crystal was filtered off. The crystal was recrystallized from a mixed solvent of methanol and concentrated hydrochloric acid (4:1 v/v) to obtain the Compound (89). Yield: 10.7 g, m.p. 228°-230° C.

SYNTHESIS EXAMPLE 6

Synthesis of Compound (90)

13.3 g of 2-amino-5-mercapto-1,3,4-thiadiazole was dissolved in 100 ml of acetonitrile and 40 ml of dimethylacetamide. 15.9 g of 3-(N,N-dimethylamino)propyl isothiocyanate was added dropwise to the solution at room temperature. The admixture was then heated with stirring at a temperature of 50° C. for 2 hours. The resulting crystal was filtered off. The crystal was recrystallized from a mixed solvent of methanol and concentrated hydrochloric acid (4:1 v/v) to obtain the Compound (90). Yield: 12.6 g, m.p. 146°-148° C.

SYNTHESIS EXAMPLE 7

Synthesis of Compound (62)

36.6 g of 5-amino-2-mercaptobenzimidazole and 17.1 ml of pyridine were added to 250 ml of N,N-dimethylacetamide. 34.4 g of phenyl chloroformate was added dropwise to the admixture at room temperature. The admixture was then stirred at room temperature for 1.5 hours. The solution was added to 1.5 l of ice water. The resulting crystal was filtered off. The crystal was recrystallized from acetonitrile to obtain 47.7 g of 2-mercapto-5-phenoxycarbonylaminobenzimidazole.

100 ml of acetonitrile was added to 8.6 g of the 2-mercapto-5-phenoxycarbonylaminobenzimidazole thus obtained. The admixture was heated to a temperature of 45° C. with stirring. 14.5 g of N,N-dimethylaminoethylenediamine was added dropwise to the solution. The admixture was then stirred at a temperature of 45° C. for 1.5 hours. The resulting crystal was filtered off. The crystal was then recrystallized from a mixed solvent of N,N-dimethylformamide and methanol (1:6 v/v) to obtain 6.2 g of the Compound (99). Yield: 74%, m.p. 240° C. (decomposition)

SYNTHESIS EXAMPLE 8

Synthesis of Compound (95)

7.8 g of p-(2-N,N-dimethylaminoethoxy)-o-phenylenediamine was added to 120 ml of an ethanol solution of 2.4 g of potassium hydroxide. 12 ml of carbon disulfide was added dropwise to the admixture at a temperature of 40° C. The admixture was then heated under reflux for 5 hours. 6 ml of concentrated hydrochloric acid was added to the reaction solution. The solvent was then removed under reduced pressure. The resulting oily residue was purified through a silica gel column. The resulting crystal was then recrystallized from acetonitrile to obtain 3.8 g of the Compound (95). Yield: 40%, m.p. 233°-235° C. (decomposition)

SYNTHESIS EXAMPLE 9

Synthesis of Compound (99)

Ethanol was added to 17.2 g of 2-mercapto-6-phenoxycarbonylaminobenzoxazole prepared in the same manner as in Synthesis Example 7. 6.2 g of N,N-diethylethylenediamine was added dropwise to the admixture. The admixture was then stirred at a temperature of 50° C. for 30 minutes. The solution was then cooled to room temperature. The resulting crystal was filtered off. The crystal was recrystallized from a mixed solvent of N,N-dimethylformamide and acetonitrile (1:5 v/v) to obtain 13.3 g of the Compound (99). Yield: 79%, m.p. 280° C. (decomposition)

SYNTHESIS EXAMPLE 10

Synthesis of Compound (3)

100 ml of ethanol was added to 10.5 g of 2,5-dimercapto-1,3,4-thiadiazole. 14 ml of a 28 (w/v) % solution of sodium methoxide was added to the admixture. The admixture was heated so that dissolution was made. 7.7 ml of 2-methylthioethyl chloride was added dropwise to the solution thus obtained. The admixture was then refluxed for 3 hours. After the reaction was completed, the reaction solution was allowed to cool to room temperature. The solution was then poured into 1 l of ice water. The resulting crystal was filtered off. The crystal was recrystallized from a mixed solvent of ethyl acetate and n-hexane (1:2 v/v) to obtain 10.8 g of the Compound (3). Yield: 68.8%, m.p. 75°-76° C.

SYNTHESIS EXAMPLE 11

Synthesis of Compound (26)

8.6 g of 2-(N-morpholino)ethyl isothiocyanate was added dropwise to a solution of 7.5 ml of hydrazine hydrate in 30 ml of ethanol under cooling with ice. The admixture was stirred for 2 hours. The resulting precipitate was filtered off. 50 ml of formic acid was added to 9.5 g of the crystal thus obtained. The admixture was then heated under reflux for 8 hours. The solvent was removed under reduced pressure to obtain a residue. The residue was neutralized with a 5 (w/v) % aqueous solution of sodium hydroxide. The residue thus neutralized was then purified using column chromatography (stationary phase: alumina; developing solvent 3:1 (v/v): ethyl acetate/methanol). The crystal thus purified was recrystallized from chloroform to obtain 4.9 g of the Compound (26). (m.p. 146°-147° C.)

SYNTHESIS EXAMPLE 12

Synthesis of Compound (28)

6.5 g of 2-dimethylaminoethyl isothiocyanate was gradually added to a solution of 7.5 ml of hydrazine hydrate in 30 ml of ethanol under cooling with ice. The admixture was then stirred for 3 hours. The reaction solution was then added to 100 ml of water. The aqueous mixture was extracted with chloroform. The organic phase was washed with saturated brine. The solvent was removed under reduced pressure. 36 ml of formic acid was added to 7.2 g of the resulting residue. The admixture was heated under reflux for 8 hours. The solvent was removed under reduced pressure to obtain a residue. The residue was then neutralized with 5 (w/v) aqueous solution of sodium hydroxide. The crystal was purified using column chromatography (stationary phase: alumina; developing solvent 3:1 (v/v): ethyl acetate/methanol). The crystal was then recrystallized from a mixed solvent of ethyl acetate and n-hexane (1:1 v/v) to obtain 3.8 g of the Compound (28). (m.p. 103°-104° C.)

SYNTHESIS EXAMPLE 13

Synthesis of Compound (103)

7.2 g of 2-dimethylaminopropyl isothiocyanate was added dropwise to a solution of 7.5 ml of hydrazine hydrate in 30 ml of ethanol under cooling with ice. The admixture was stirred for 3 hours. The reaction solution was added to 100 ml of water. The aqueous mixture was then extracted with ether. The ether layer was washed with saturated brine. The solvent was removed under reduced pressure. 40 ml of formic acid was added to 7.8 g of the resulting residue. The admixture was heated under reflux for 8 hours. The solvent was removed under reduced pressure to obtain a residue. The residue was then neutralized with 5 (w/v) % aqueous solution of sodium hydroxide. The resulting crystal was purified using column chromatography (stationary phase: alumina; developing solvent (3:1) (v/v): ethyl acetate/methanol). The crystal was recrystallized from isopropyl alcohol to obtain 4.5 g of the Compound (103). (m.p. 161°-163° C.)

SYNTHESIS EXAMPLE 14

Synthesis of Compound (42)

13 g of 2-dimethylaminoethyl was gradually added to a solution of 13.3 g of aminoacetaldehyde diethylacetal in 100 ml of carbon tetrachloride under cooling with ice. The admixture was stirred at room temperature for 2 hours. The solvent was then removed under reduced pressure. 110 ml of 35 (v/v) % sulfuric acid was added to the resulting residue under cooling with ice. The admixture was heated under reflux for 3 hours. The reaction solvent was neutralized with 35 (w/v) % aqueous solution of sodium hydroxide. The organic phase was dried over sodium sulfate anhydride. The solvent was removed under reduced pressure. The resulting residue was recrystallized from ethyl acetate to obtain 6.8 g of the Compound (42). (m.p. 130°-131° C.)

SYNTHESIS EXAMPLE 15

Synthesis of Compound (43)

17.2 g of 2-(N-morpholino)ethyl isothiocyanate was added dropwise to a solution of 13.3 g of aminoacetaldehyde diethylacetal in 100 ml of carbon tetrachloride under cooling with ice. The admixture was stirred at room temperature for 2.5 hours. The solvent was removed under reduced pressure. 110 ml of sulfuric acid was added to the resulting residue under cooling with ice. The admixture was heated under reflux for 4 hours. The reaction solution was neutralized with 30 (w/v) % aqueous solution of sodium hydroxide. The aqueous mixture was extracted with chloroform. The resulting organic phase was dried with sodium sulfate anhydride. The solvent was removed under reduced pressure. The resulting residue was recrystallized from isopropyl alcohol to obtain 7.5 g of the Compound (43). (m.p. 154°-156° C.)

SYNTHESIS EXAMPLE 16

Synthesis of Compound (56)

A mixed solution of 17.2 g of 2-(N-morpholino)ethyl isothiocyanate and 20 ml of dioxane was added dropwise to a solution of 7.2 g of sodium azide in 50 ml of water which had been heated to a temperature of 80° C. The admixture was stirred at a temperature of 80° C. for 1 hour. After the reaction was completed, the insoluble matters were filtered off. 8.8 ml of concentrated sulfuric acid was added to the filtrate. The resulting crystal was filtered off. The crystal was then recrystallized from a mixed solvent of methanol and water (3:1 v/v) to obtain 14.1 g of the Compound (56). (m.p. 139°-141° C.)

SYNTHESIS EXAMPLE 17

Synthesis of Compound (83)

150 ml of benzene was added to 11.2 g of 5-phenoxycarbonyl benzotriazole and 4.4 g of N,N-dimethylethylenediamine. The admixture was heated under reflux for 4 hours. The reaction solution was then cooled to room temperature. The resulting crystal was filtered off. The crystal was recrystallized from methanol to obtain 7.9 g of the Compound (83). (m.p. 182°-184° C.)

The present nucleation accelerator may be incorporated in the light-sensitive material or the processing solution. In particular, the present nucleation accelerator is preferably incorporated in an internal latent image type silver halide emulsion layer or other hydrophilic colloid layer (e.g., intermediate layer or protective layer). More preferably, the present nucleation accelerator is incorporated in a silver halide emulsion layer or its adjacent layers.

The added amount of the present nucleation accelerator when it is incorporated in a silver halide emulsion layer or its adjacent layers is preferably $10^{-6}$ to $10^{-2}$ mol, more preferably $10^{-5}$ to $10^{-2}$ mol, per mol of silver halide.

If the present nucleation accelerator is incorporated in the processing solution, i.e., developing solution or its prebath, the added amount thereof is preferably $10^{-7}$ to $10^{-3}$ mol, more preferably $10^{-7}$ to $10^{-4}$ mol per liter of the developing solution or its prebath.

The unfogged internal latent image type silver halide emulsion to be used in the present invention is an emulsion containing silver halide grains are not previously fogged on their surface and form latent images mainly in the inside thereof. More particularly, it is preferably a silver halide emulsion whose maximum density measured by an ordinary photographic density measuring method is at least 5 times, more preferably 10 times greater when it is coated on a transparent support in a predetermined amount, exposed to light for a fixed period of time ranging from 0.01 to 10 seconds, and developed with the developing solution A (internal type) below at a temperature of 20° C. for 6 minutes than when developed with the developing solution B (surface type) below at a temperature of 18° C. for 5 minutes.

| | |
|---|---|
| Internal Developing Solution A | |
| Metol | 2 g |
| Sodium sulfite (anhydride) | 90 g |
| Hydroquinone | 8 g |
| Sodium carbonate (monohydrate) | 52.5 g |
| KBr | 5 g |
| KI | 0.5 g |
| Water to make | 1 liter |
| Surface Developing Solution B | |
| Metol | 2.5 g |
| l-Ascorbic acid | 10 g |
| $NaBO_2 \cdot 4H_2O$ | 35 g |
| KBr | 1 g |
| Water to make | 1 liter |

Specific examples of the internal latent image type emulsion include conversion type silver halide emulsions and core/shell type silver halide emulsions as described in British Patent No. 1,011,062, and U.S. Pat. Nos. 2,592,250 and 2,456,943. Examples of such core/-shell type silver halide emulsions include emulsions as described in Japanese Patent Application (OPI) Nos. 32813/72, 32814/72, 134721/77, 156614/77, 60222/78, 66218/78, 66727/78, 127549/80, 136641/82, 70221/83, 208540/84, 216136/84, 107641/85, 247237/85, 2148/86 and 3137/86, Japanese Patent Publication Nos. 18938/81, 1412/83, 1415/83, 6935/83 and 108528/83, Japanese Patent Application No. 36424/86, U.S. Pat. Nos. 3,206,313, 3,317,322, 3,761,266, 3,761,276, 3,850,637, 3,923,513, 4,035,185, 4,395,478 and 4,504,570, European Patent No. 0017148, and Research Disclosure No. 16345 (Nov., 1977).

Typical examples of the present silver halide composition are mixed silver halides such as silver chlorobromide, silver chloride and silver bromide. Examples of silver halides which may be preferably used in the present invention are silver chloro(iodo) bromide, silver (iodo)chloride, and silver (chloro)bromide each containing 3% or less of silver iodide, if any.

The average particle size of the present silver halide grains (particle diameter for spherical or nearly spherical particles; edge length for cubic particles, represented in terms of the average as calculated on the basis of the projected area) is preferably in the range of 0.1 to 2 μm, and more preferably in the range of 0.15 to 1 μm. The particle size distribution may be narrow or wide. For better graininess or sharpness, a so-called "monodisperse" silver halide emulsion is preferably used in the present invention. In such a monodisperse silver halide emulsion, 90% or more, particularly 95% or more of all the particles falls within ±40%, preferably ±30%, more preferably ±20% of the average particle size by particle number or weight. In order to satisfy the desired gradation for the light-sensitive material, in an emulsion layer having substantially the same color sensitivities, two or more monodisperse silver halide emulsions having different particle sizes or a plurality of particles having the same size and different sensitivities may be coated on the same layer in combination or may be separately coated on separate layers. Furthermore, two or more polydisperse silver halide emulsions or combinations of monodisperse emulsion and polydisperse emulsion may be used in combination in the same layer or separately in separate layers.

The shape of the present silver halide grains may be in the form of regular crystal such as cube, octahedron, dodecahedron, and tetradecahedron, irregular crystal such as sphere, or composite thereof. The present silver halide grains may also be in the form of tabular grains. In particular, an emulsion of tabular grains in which tabular grains having a ratio of length to thickness of 5 or more, particularly 8 or more, account for 50% or more of the total projected area of the grains may be used. The present silver halide emulsion may be an emulsion comprising a mixture of these various crystal shapes.

The present silver halide emulsion may be chemically sensitized in the inside of the grains or on the surface thereof by a sulfur or selenium sensitization process, a reduction sensitization process, or a noble metal sensitization process, alone or in combination.

The present photographic emulsion may be subjected to a spectral sensitization process with a photographic sensitizing dye in a conventional manner. Particularly useful dyes are those belonging to cyanine dyes, merocyanine dyes, and composite merocyanine dyes. These dyes may be used, alone or in combination. These dyes may also be used in combination with any suitable supersensitizing dyes.

Specific examples of such dyes and their use are described in Research Disclosure, No. 17643 (Dec. 1978).

In order to inhibit fogging during manufacture, storage or photographic processing of the light-sensitive material or to stabilize the photographic properties thereof, the present photographic emulsion may contain benzenethiosulfonic acids, benzenesulfinic acids, thiocarbonyl compounds, or the like.

Further specific examples of such fog inhibitors or stabilizers and their use are described in, e.g., U.S. Pat. Nos. 3,954,474 and 3,982,947, Japanese Patent Publication No. 28660/77, *Research Disclosure*, No. 17643, VIA-VIM (Dec., 1978), and *Stabilization of Photographic Silver Halide Emulsions* (edited by E. J. Birr, published by Focal Press, 1974).

The present nucleating agent may be incorporated in the light-sensitive material or processing solution for the light-sensitive material, preferably in the light-sensitive material.

If the present invention agent is incorporated in the light-sensitive material, it is preferably incorporated in an internal latent image type silver halide emulsion layer. However, if the nucleating agent is diffused and adsorbed by the silver halide during coating or processing, it may be incorporated in other layers such as an intermediate layer, an undercoat layer, and a backing layer. If the nucleating agent is incorporated in the processing solution, it may be added to the developing solution or a low pH prebath as described in Japanese Patent Application (OPI) No. 178350/83.

If the nucleating agent is incorporated in the light-sensitive material, its used amount is preferably in the range of $10^{-8}$ to $10^{-2}$ mol, more preferably in the range of $10^{-7}$ to $10^{-3}$ mol per mol of silver halide.

If the nucleating agent is incorporated in the processing solution, its used amount is preferably in the range of $10^{-8}$ to $10^{-3}$ mol, more preferably in the range of $10^{-7}$ to $10^{-4}$ mol per liter of processing solution.

As such nucleating agents there can be used all compounds which have been employed for nucleating internal latent image type silver halides. Such nucleating agents can be used, alone or in combination. More particularly, as such nucleating agents there may also be used compounds as described in *Research Disclosure*, No. 22534 (pp. 50–54, published in Jan. 1983). These compounds are roughly divided into three types, hydrazine compounds, quaternary heterocyclic compounds, and other compounds.

Examples of such hydrazine compounds include those described in *Research Disclosure*, Nos. 15162 (published in Nov. 1976, pp. 76–77) and 23510 (published in Nov. 1983, pp. 346–352). Specific examples of such hydrazine compounds include those described in the following patent specifications. Examples of hydrazine nucleating agents containing silver halide adsorption groups include those described in U.S. Pat. Nos. 4,030,925, 4,080,207, 4,031,127, 3,718,470, 4,269,929, 4,276,364, 4,278,748, 4,385,108 and 4,459,347, British Patent No. 2,011,391B, and Japanese Patent Application (OPI) Nos. 74729/79, 163533/80, 74536/80 and 179734/85.

Other examples of such hydrazine nucleating agents include the compounds as described in Japanese Patent Application (OPI) No. 86829/82, and U.S. Pat. Nos. 4,560,638, 4,478, 2,563,785 and 2,588,982.

Examples of the quaternary heterocyclic compound include those described in Research Disclosure No. 22534, Japanese Patent Publication Nos. 38164/74, 19452/77 and 47326/77, Japanese Patent Application (OPI) Nos. 69613/77, 3,426/77, 138742/80 and 11837/85, U.S. Pat. No. 4,306,016, and Research Disclosure No. 23213 (published in Aug. 1983, pp. 267–270).

The nucleating agent useful in the present invention is preferably a compound of general formula (N-I) or (N-II):

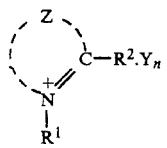

(N-I)

wherein Z represents a nonmetallic atomic group required to form a 5- or 6-membered hetero ring and may be substituted with substituents; $R^1$ represents an aliphatic group; $R^2$ represents a hydrogen atom, an aliphatic group, or an aromatic group; $R^1$ and $R^2$ each may be substituted with substituents; Y represents a counter ion for electric charge balance; n represents 0 or 1; with the proviso that at least one of $R^1$, $R^2$ and Z contains alkynyl groups, acyl groups, hydrazine groups, or hydrazone groups, or $R^1$ and $R^2$ together form a 6-membered ring, thereby forming a dihydropyridinium skeleton and that at least one of the substituents of $R^1$, $R^2$ and Z contains $X^1$-$(L^1)_m$ in which $X^1$ represents a group which accelerates adsorption by silver halide; and $L^1$ represents a divalent linkage group and m represents an integer of 0 or 1.

More particularly, examples of the heterocyclic ring completed by Z include a quinolinium nucleus, a benzothiazolium nucleus, a benzimidazolium nucleus, a pyridinium nucleus, a thiazolinium nucleus, a thiazolium nucleus, a naphthothiazolium nucleus, a selenazolium nucleus, a benzoselenazolium nucleus, an imidazolium nucleus, a tetrazolium nucleus, an indolenium nucleus, a pyrrolinium nucleus, an acridinium nucleus, a phenanthridinium nucleus, an isoquinolinium nucleus, an oxazolinium nucleus, a naphthoxazolinium nucleus, and a benzoxazolinium nucleus. Examples of the substituents for Z include an alkyl group, an alkenyl group, an aralkyl group, an aryl group, an alkynyl group, a hydroxy group, an alkoxy group, an aryloxy group, a halogen atom, an amino group, an alkylthio group, an arylthio group, an acyloxy group, an acylamino group, a sulfonyl group, a sulfonyloxy group, a sulfonylamino group, a carboxyl group, an acyl group, a carbamoyl group, a sulfamoyl group, a sulfo group, a cyano group, a ureido group, a urethane group, a carbonic acid ester group, a hydrazine group, a hydrazone group, and an imino group. At least one is selected from the above substituents as substituents for Z. If two or more such substituents are selected, they may be the same or different. The above substituents may be further substituted with these substituents.

Furthermore, examples of the substituents for Z include heterocyclic quaternary ammonium groups formed by Z via suitable linkage group $L^1$. In this case, such substituents have a so-called dimer structure.

Preferred examples of the heterocyclic ring completed by Z include a quinolinium nucleus, a benzothiazolium nucleus, a benzimidazolinium nucleus, a pyridinium nucleus, an acridinium nucleus, a phenanthridinium nucleus, and an isoquinolinium nucleus. More preferred among these nuclei are a quinolinium nucleus, a benzothiazolium nucleus, and a benzimidazolium nucleus. Further preferred among these nuclei are a quinolinium nucleus and a benzothiazolium nucleus. Most preferred among these nuclei is a quinolinium nucleus.

The aliphatic group represented by $R^1$ or $R^2$ is a $C_{1-18}$ unsubstituted alkyl group or substituted alkyl group containing an alkyl moiety with 1 to 18 carbon atoms. As such substituents there may be used those for Z.

The aromatic group represented by $R^2$ is a $C_{6-20}$ aromatic group such as a phenyl group an a naphthyl group. As the substituents for these groups there may be used those for Z.

At least one of the groups represented by $R^1$, $R^2$ and Z contains alkyl groups, acyl groups, hydrazine groups, or hydrazone groups. Alternately, $R^1$ and $R^2$ together form a 6-membered ring, thereby forming a dihydropyridinium skeleton structure. These groups may be substituted with groups previously described as substituents for the group represented by Z.

As such hydrazine groups there may be preferably used those containing acyl groups or sulfonyl groups as substituents.

As hydrazone groups there may be preferably used those containing aliphatic groups or aromatic groups as substituents.

Preferred examples of the acyl group include formyl groups, aliphatic ketone groups, and aromatic ketone groups.

Examples of alkynyl substituents contained in any of $R^1$, $R^2$ and Z have been described above. Preferred examples of such alkynyl substituents include $C_{2-18}$ alkynyl substituents such as an ethynyl group, an propargyl group, a 2-butynyl group, a 1-methylpropargyl group, a 1,1-dimethylpropargyl group, a 3-butynyl group, and a 4-pentynyl group.

The alkynyl group represented by $R^2$ may be connected to the heterocyclic ring to be completed by Z to form a 5- or 6-membered ring which is condensed with the heterocyclic ring.

Furthermore, these alkynyl substituents may be substituted with the groups previously described as the subtuents for Z. Examples of such substituted groups include 3-phenylpropargyl group, a 3-methoxycarbonylpropargyl group, and a 4-methoxy-2-butynyl group.

At least one of the substituents for the group or ring represented by $R^1$, $R^2$ and Z is preferably an alkynyl or an acyl group or a dihydropyridinium skeleton formed by the linkage of $R^1$ and $R^2$. Furthermore, the substituent for the group or ring represented by $R^1$, $R^2$ and Z most preferably contains at least one alkynyl group.

Preferred examples of the group $X^1$ which accelerates adsorption by silver halide include thioamido groups, mercapto groups, and 5- or 6-membered nitrogen-containing heterocyclic groups.

The thioamido adsorption acceleration group represented by $X^1$ is a divalent group represented by

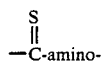

which may be a portion of a ring structure or an acyclic thioamido group. Useful thioamido acceleration groups can be selected from those disclosed in U.S. Pat. Nos. 4,030,925, 4,031,127, 4,080,207, 4,245,037, 4,255,511, 4,266,013 and 4,276,364, and *Research Disclosure* Nos. 15162 (Vol. 151, Nov. 1976) and 17626 (Vol. 176, Dec. 1978).

Specific examples of the acyclic thioamido group include thioureido groups, thiourethane groups, and dithiocarbamic acid ester groups. Specific examples of the cyclic thioamido group include 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-thiadiazoline-2-thione, 1,3,4-oxadiazoline, benzimidazoline-2-thione, benzoxazoline-2-thione, and benzothiazoline-2-thione. These groups may be further substituted.

Examples of the mercapto group represented by $X^1$ include those containing an —SH group directly connected to the group represented by $R^1$, $R^2$ or Z and those containing an —SH group connected to the substituent for the group represented by $R^1$, $R^2$ or Z. Examples of such mercapto groups include aliphatic mercapto groups, aromatic mercapto groups, and heterocyclic mercapto groups (if the atom next to the carbon atom to which the —SH group is connected is a nitrogen atom, such heterocyclic mercapto groups are present in the same number as that of the cyclic thioamido groups in tautomerism therewith. Specific examples of such heterocyclic mercapto groups include those described above).

Examples of the 5- or 6-membered nitrogen-containing heterocyclic group represented by $X^1$ include 5- or 6-membered nitrogen-containing heterocyclic rings comprising combinations of nitrogen atoms, oxygen atoms, sulfur atoms, and carbon atoms. Preferred examples of such 5- or 6-membered nitrogen-containing heterocyclic rings include benzotriazole, triazole, tetrazole, indazole, benzimidazole, imidazole, benzothiazole, thiazole, benzoxazole, oxazole, thiadiazole, oxadiazole, and triazine. These groups may be further substituted with suitable substituents. As such substituents there may be used those described as the substituents for Z. More preferred among these nitrogen-containing heterocyclic rings are benzotriazole, triazole, tetrazole, and indazole. Most preferred among these groups is benzotriazole.

As the divalent linkage group represented by $L^1$ there may be used atoms or atomic groups containing at least one of C, N, S, and O. Specific examples of such atoms or atomic groups are an alkylene group, an alkenylene group, an alkynylene group, an arylene group, —O—, —S—, —NH—, —N=, —CO—, and —$SO_2$—. These atoms or atomic groups may be used alone or in combination.

The counter ion Y for electric charge balance is an anion which can offset the positive charge produced by a quaternary ammonium salt in a heterocyclic ring. Examples of such an anion include a bromine ion, a chlorine ion, an iodine ion, a p-toluenesulfonic acid ion, an ethylsulfonic acid ion, a perchloric acid ion, a trifluoromethanesulfonic acid ion, and a thiocyan ion. In this case, n is 1. If the heterocyclic quaternary ammonium salt contains an anion substituent such as a sulfoalkyl substituent, it may be in the form of betaine. In this case, no counter ions are required, and n is 0. If the heterocyclic quaternary ammonium salt contains two anion substituents, e.g., two sulfoalkyl groups, Y is a cationic counter ion. Examples of such a cationic counter ion include alkali metal ions such as sodium ions, and potassium ions, and ammonium salts such as triethyl ammonium.

Specific examples of the compound represented by general formula (N-1) will be shown hereinafter, but the present invention should not be construed as being limited thereto.

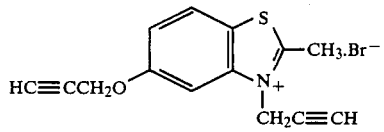

(1)

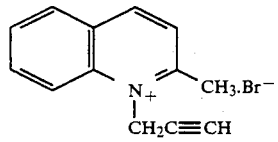

(2)

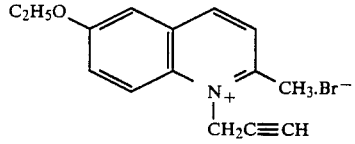

(3)

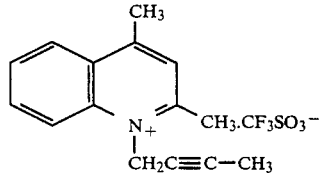

(4)

-continued
(5)
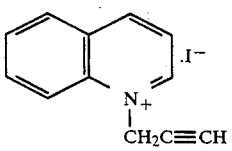
(6)
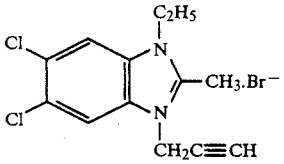
(7)
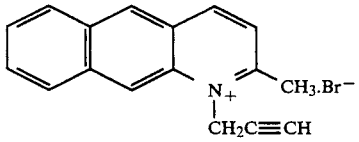
(8)
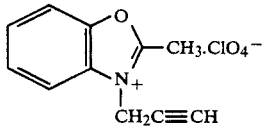
(9)
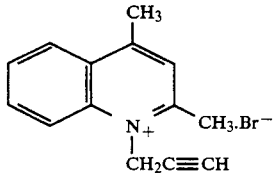
(10)
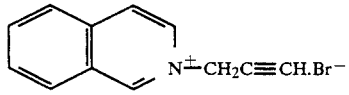
(11)
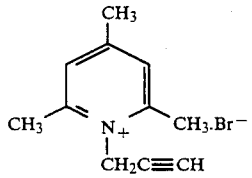
(12)
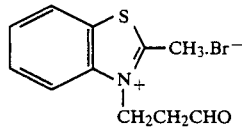
(13)
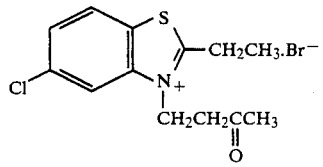

-continued
(14)
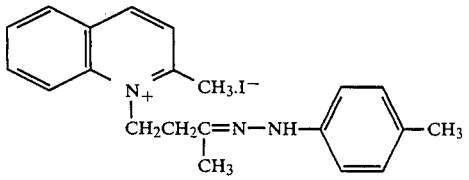
(15)
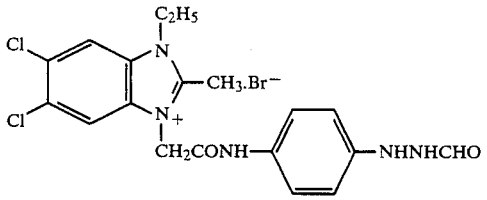
(16)
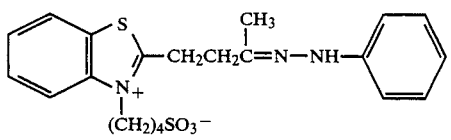
(17)
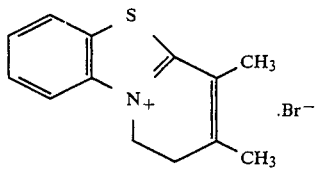
(18)
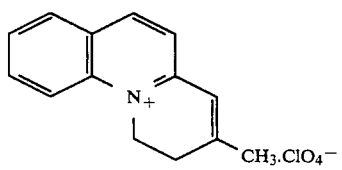
(19)
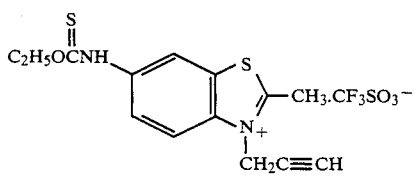
(20)
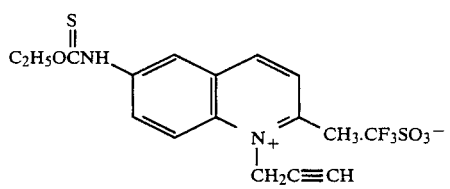
(21)
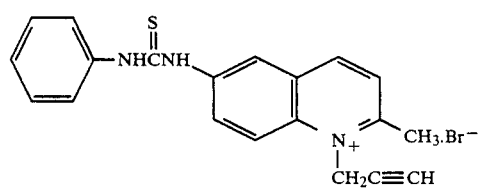
(22)
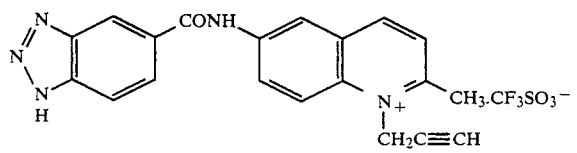

-continued
(23)
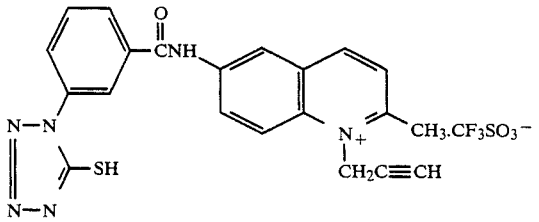
(24)
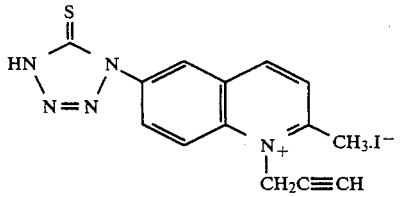
(25)
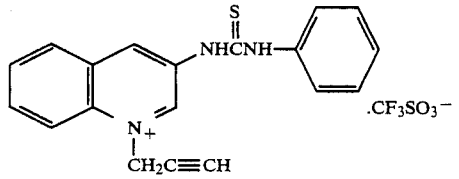
(26)
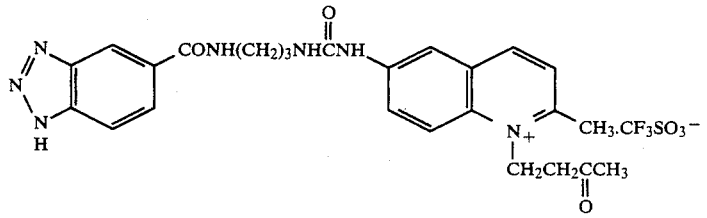
(27)
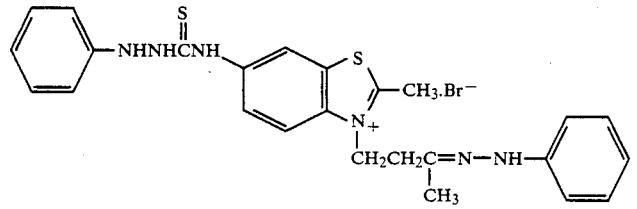
(28)
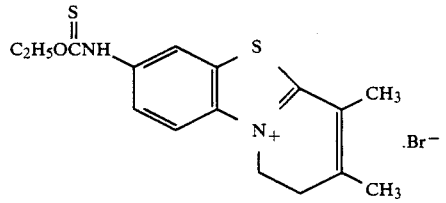
(29)
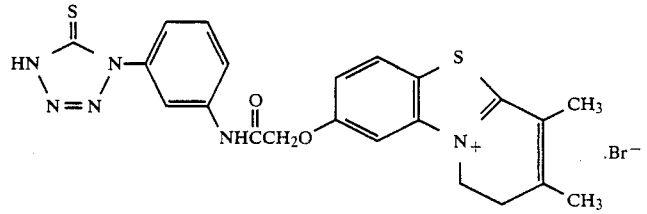

-continued (30)

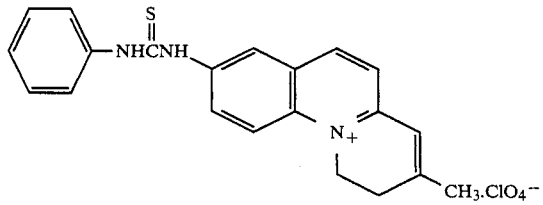

(31)

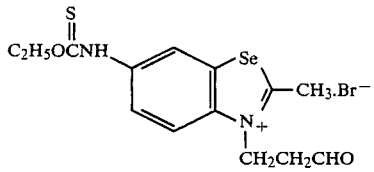

(32)

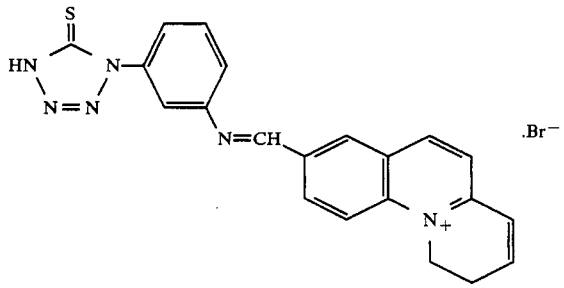

(33)

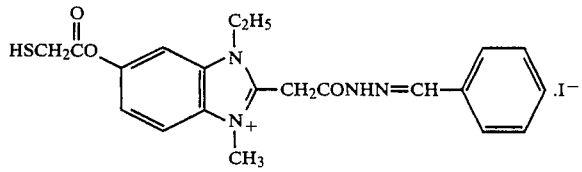

(34)

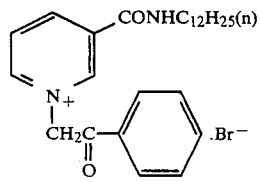

(35)

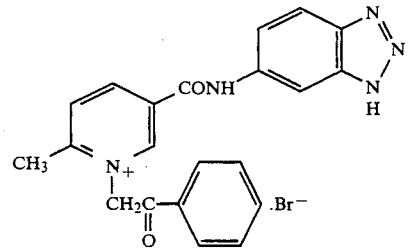

The synthesis of the above mentioned compounds can be accomplished by methods as described in the patents cited in *Research Disclosure* No. 22534 (pp. 50–54, published in Jan. 1983), and U.S. Pat. No. 4,471,044, and analogous methods.

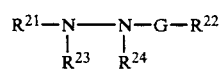

(N-II)

wherein $R^{21}$ represents an aliphatic group, an aromatic group, or a heterocyclic group; $R^{22}$ represents a hydrogen atom, an alkyl group, an aralkyl group, an aryl group, an alkoxy group, an aryloxy group, or an amino group; G represents a carbonyl group, a sulfonyl group, a sulfoxy group, a phosphoryl group, or an iminomethylene group (HN=C<); and $R^{23}$ and $R^{24}$ each represents a hydrogen atom, or one of $R^{23}$ and $R^{24}$ represents a hydrogen atom and the other represents any one of an alkylsulfonyl group, an arylsulfonyl group, and an acyl group with the proviso that a hydrazone structure (>N—N=C<) containing G, $R^{23}$, $R^{24}$ and a hydrazine nitrogen may be formed. If possible, the above-mentioned groups may be substituted with substituents.

In general formula (N-II) the aliphatic group represented by $R^{21}$ is a straight-chain, branched or cyclic alkyl, alkenyl or alkynyl group.

The aromatic group represented by $R^{21}$ is a monocyclic or bicyclic aryl group such as a phenyl group and a naphthyl group.

The heterocyclic ring represented by $R^{21}$ is a 3- to 10-membered saturated or unsaturated heterocyclic ring containing at least one of N, O and S. Such a heterocyclic ring may be monocyclic or may form a condensed ring together with other aromatic rings or heterocyclic rings. Preferred examples of such a heterocyclic ring represented by $R^{21}$ include a 5-membered or 6-membered aromatic heterocyclic ring such as a pyridyl group, a quinolinyl group, an imidazolyl group, and a benzimidazolyl group.

$R^{21}$ may be substituted with substituents. Examples of such substituents will be described hereinafter. These substituents may be further substituted.

Examples of the above mentioned substituents include an alkyl group, an aralkyl group, an alkoxy group, an alkyl or an aryl group, a substituted amino group, an acylamino group, a sulfonylamino group, a ureido group, a urethane group, an aryloxy group, a sulfamoyl group, a carbamoyl group, an aryl group, an alkylthio group, an arylthio group, a sulfonyl group, a sulfinyl group, a hydroxy group, a halogen atom, a cyano group, a sulfo group, and a carboxyl group.

If possible, these substituents may be linked to each other to form a ring.

Preferred examples of $R^{21}$ include an aromatic group, an aromatic heterocyclic ring, and an aryl-substituted methyl group, more preferred example of $R^{21}$ is an aryl group.

If G is a carbonyl group, preferred examples of the group represented by $R^{22}$ include a hydrogen atom, an alkyl group such as a methyl group, a trifluoromethyl group, a 3-hydroxypropyl group, and a 3-methanesulfonamidopropyl group, an aralkyl group such as an o-hydroxybenzyl group, and an aryl group such as a phenyl group, a 3,5-dichlorophenyl group, an o-methanesulfonamidophenyl group, and an 4-methanesulfonylphenyl group. Particularly preferred example of the group is a hydrogen atom.

If G is a sulfonyl group, $R^{22}$ is preferably an alkyl group such as a methyl group, an aralkyl group such as an o-hydroxyphenylmethyl group, an aryl group such as a phenyl group, and a substituted amino group such as a dimethylamino group.

As the substituents for $R^{22}$ there may be used those described as the substituents for $R^{12}$. Besides these substituents, an acyl group, an acyloxy group, an alkyl or aryloxycarbonyl group, an alkenyl group, an alkynyl group, or a nitro group may be used.

These groups may be further substituted with these substituents. If possible, these substituents may be linked to each other to form a ring.

$R^{21}$ or $R^{22}$, particularly $R^{21}$, preferably contains a diffusion resistant coupler group, i.e., so-called ballast group. Such a ballast group is a group with 8 or more carbon atoms consisting of one or more combinations of an alkyl group, a phenyl group, an ether group, an amido group, a ureido group, a urethane group, a sulfonamido group, and a thioether group.

$R^{21}$ or $R^{22}$ may contain a group $X^2$-$(L^2)_{m^2}$ which accelerates the adsorption of the compound of general formula (N-II) by the surface of silver halide grains. $X^2$ has the same meaning as $X^1$ in general formula (N-I) and is preferably a thioamido group (except thiosemicarbazide and substituted compounds thereof), a mercapto group, or a 5- or 6-membered nitrogen-containing heterocyclic group. $L^2$ represents a divalent linkage group and has the same meaning as $L^1$ in general formula (N-1). The suffix $m^2$ is an integer of 0 or 1.

More preferred examples of $X^2$ include cyclic thioamido groups, i.e., mercapto-substituted nitrogen-containing heterocyclic rings such as a 2-mercaptothiadiazole group, a 3-mercapto-1,2,4-triazole group, a 5-mercaptotetrazole group, a 2-mercapto-1,3,4-oxadiazole group, and a 2-mercaptobenzoxazole group, and a nitrogen-containing heterocyclic groups such as a benzotriazole group, a benzimidazole group, and an indazole group.

$R^{23}$ and $R^{24}$ each are most preferably a hydrogen atom. G is general formula (N-II) is most preferably a carbonyl group.

The compound of general formula (N-II) more preferably contains a group which is adsorbed by silver halide. Particularly preferred examples of such an adsorption group include a mercapto group, a cyclic thioamido group, and a nitrogen-containing heterocyclic group described with reference to general formula (N-I).

Specific examples of the compound of general formula (N-II) will be shown hereinafter, but the present invention should not be construed as being limited thereto.

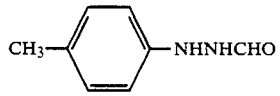

(36)

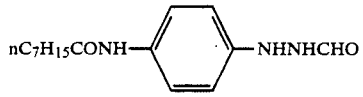

(37)

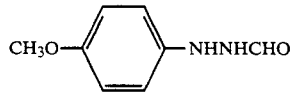

(38)

-continued
(39)
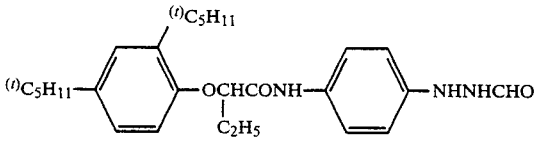
(40)
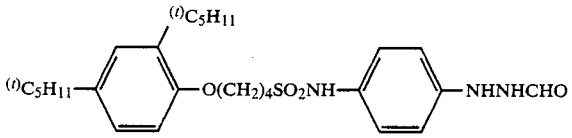
(41)
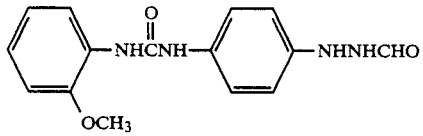
(42)
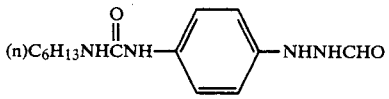
(43)
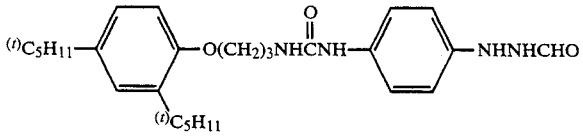
(44)
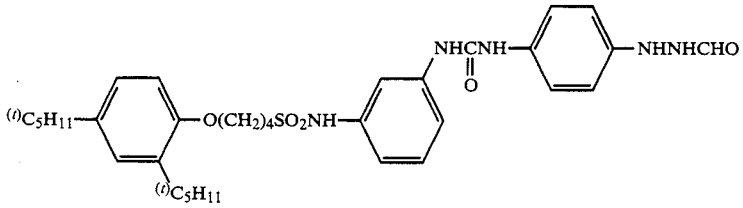
(45)
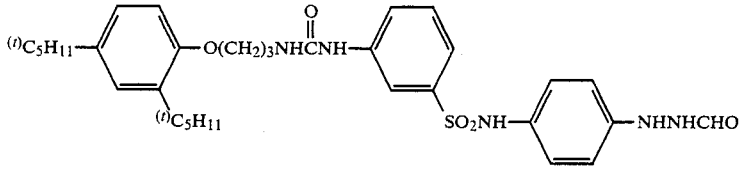
(46)
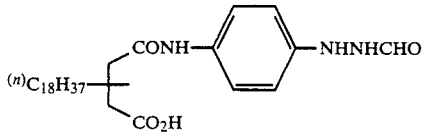
(47)
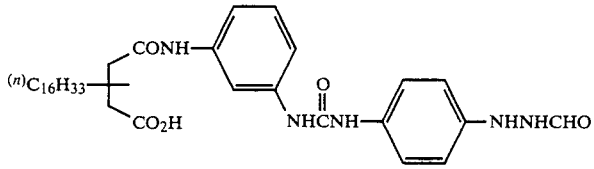
(48)
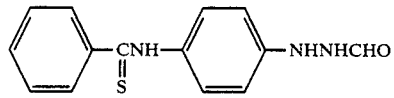

-continued
(49)
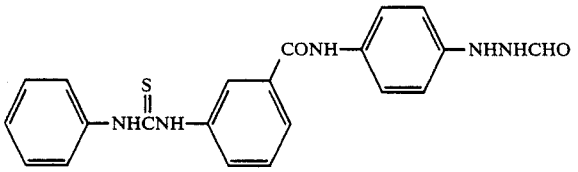
(50)
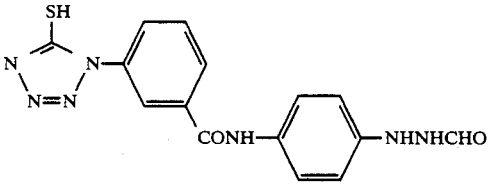
(51)
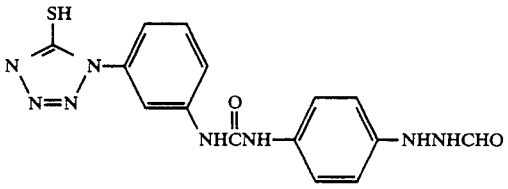
(52)
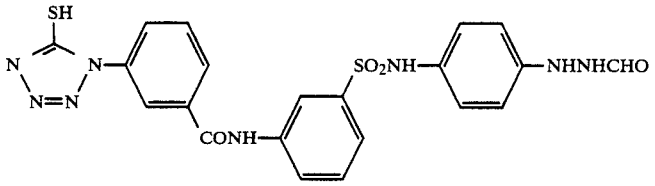
(53)
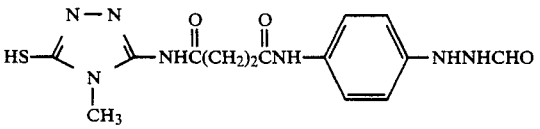
(54)
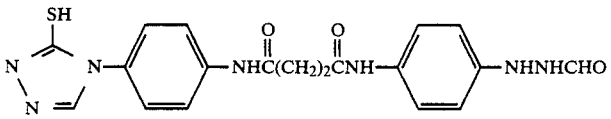
(55)
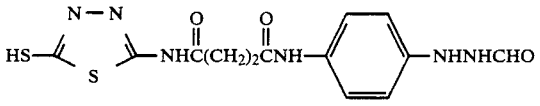
(56)
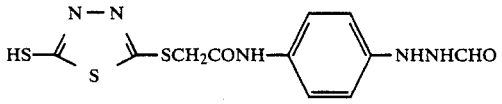
(57)
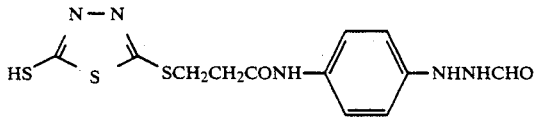
(58)
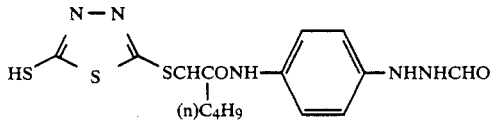

-continued
(59)
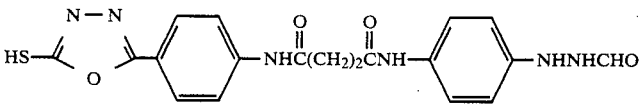
(60)
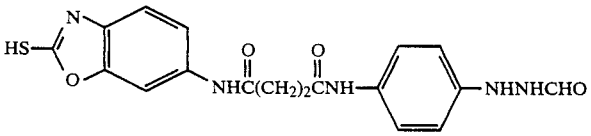
(61)
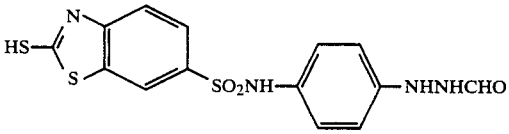
(62)
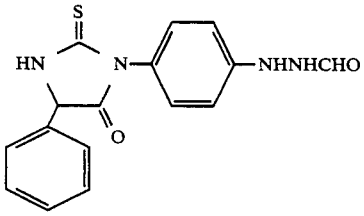
(63)
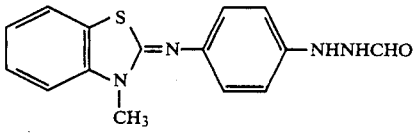
(64)
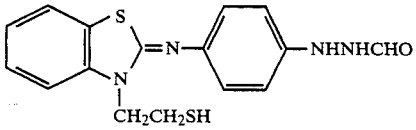
(65)
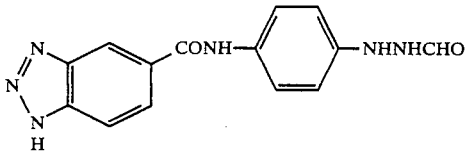
(66)
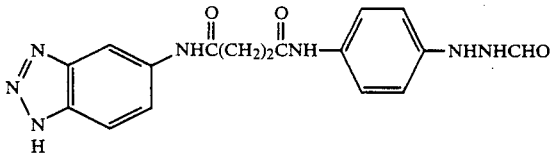
(67)
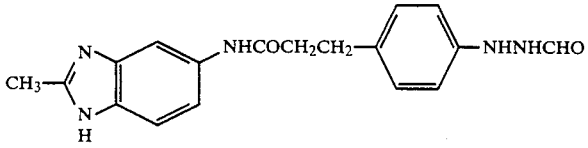
(68)
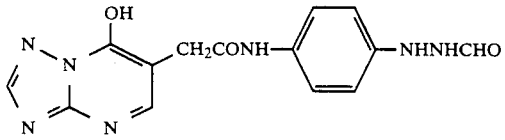

-continued
(69)
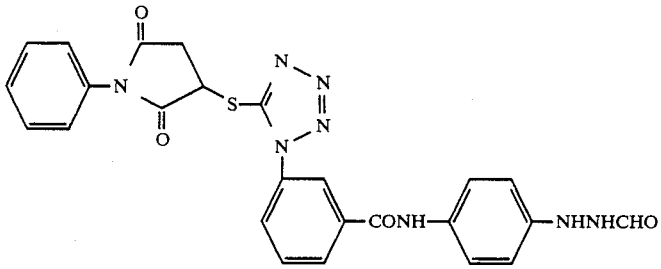
(70)
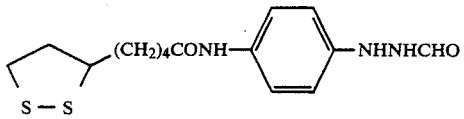
(71)
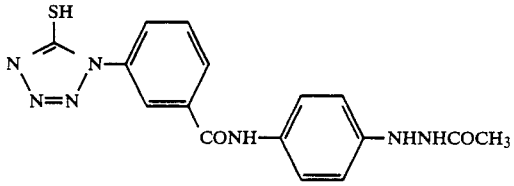
(72)
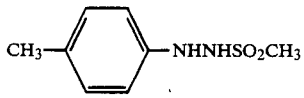
(73)
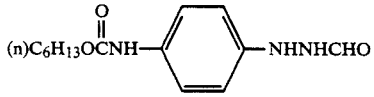
(74)
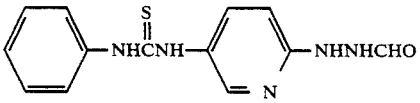
(n)$C_{12}H_{25}$NHNHCHO (75)
(76)
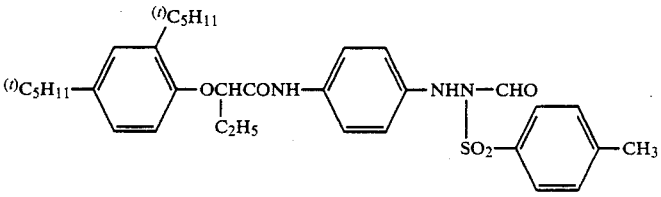
(77)
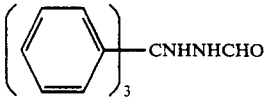
(78)
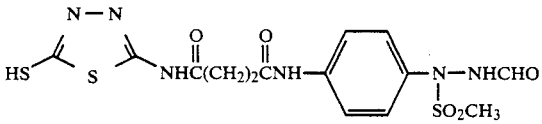

-continued

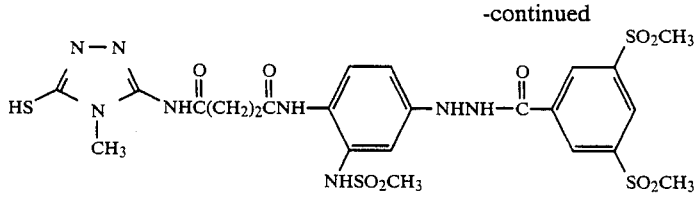

(79)

The synthesis of the compound of general formula (N-II) to be used in the present invention can be accomplished by any suitable methods as described in the patents cited in *Research Disclosure* Nos. 15162 (pp. 76–77, Nov. 1976), 22534 (pp. 50–54, Jan. 1983), and 23510 (pp. 346–352, Nov. 1983), and U.S. Pat. Nos. 4,080,207, 4,269,924, 4,276,364, 4,278,748, 4,385,108, 4,459,347, 4,478,928 and 4,560,638, British Patent No. 2,011,391B, and Japanese Patent Application (OPI) No. 179734/85.

In the present invention, it is preferred to use a nucleating agent of general formula (N-I). Of the nucleating agents of general formula (N-I), the following groups of compounds (1) to (8) are preferred in this order. The group of compounds (8) is most preferred.

(1) Those compounds of general formula (N-I) which contain a group which accelerates adsorption by silver halide represented by $X^1$.

(2) The compounds described in (1) above in which the group represented by $X^1$ is a thioamido group, a heterocyclic mercapto group or a nitrogen-containing heterocyclic ring which can form imino silver.

(3) The compounds described in (2) above, in which the heterocyclic ring completed by Z is quinolinium, isoquinolinium, naphthopyridinium or benzothiazolium.

(4) The compounds described in (2) above, in which the heterocyclic ring completed by Z is quinolinium.

(5) The compounds described in (2) above, which contain an alkynyl group as a substituent for $R^1$, $R^2$ or Z.

(6) The compounds described in (5) above, in which $R^1$ is a propargyl group.

(7) The compounds described in (2) above, in which the thioamido group represented by $X^1$ is a thiourethane group and the heterocyclic mercapto group represented by $X^1$ is a mercaptotetrazolyl group, a mercaptothiadiazolyl group or a mercaptotriazolyl group.

(8) The compounds described in (6) above, in which $R^2$ is connected to the heterocyclic ring to be completed by Z to form a 5- or 6-membered ring which is condensed with a heterocyclic ring.

When the nucleating agent of general formula (N-II) is used, the following groups (1) to (6) are preferred in this order. Of these, group (5) is most preferred.

(1) The compounds of general formula (N-II), in which $R^1$ or $R^2$ has a group which accelerates adsorption by silver halide represented by $X^2$.

(2) The compounds described in (2) above, in which the group represented by $X^2$ is a heterocyclic mercapto group or a nitrogen-containing heterocyclic ring which can form imino silver.

(3) The compounds described in (2) above, in which the group represented by C—$R^{22}$ is a formyl group.

(4) The compounds described in (3) above, in which $R^{23}$ and $R^{24}$ each are a hydrogen atom.

(5) The compounds described in (3) above, in which $R^{21}$ is an aromatic group.

(6) The compounds described in (2) above, in which the heterocyclic mercapto group represented by $X^2$ is a 5-mercaptotetrazolyl group or a 5-mercapto-1,2,4-triazolyl group or a 5-mercapto-1,3,4-thiadiazole group.

The nucleation accelerator of general formula (II) or (III) is preferably used in combination with a nucleating agent of general formula (N-I) or a nucleating agent of general formula (N-II) containing a mercapto group, a cyclic thioamido group or a nitrogen-containing heterocyclic group as group which is adsorbed by silver halide.

In order to improve the effect of acceleration of nucleation according to the present invention, the nucleation accelerator of general formula (I), (II) or (III) can be used in combination with compounds such as hydroquinones (e.g., compounds as described in U.S. Pat. Nos. 3,227,552 and 4,279,987), chromans (e.g., compounds as described in U.S. Pat. No. 4,268,621, Japanese Patent Application (OPI) No. 103031/79, and *Research Disclosure* No. 18264 (1979)), quinones (e.g., compounds as described in Research Disclosure No. 21206 (1981)), amines (e.g., compounds as described in U.S. Pat. No. 4,150,993, and Japanese Patent Application (OPI) No. 174757/83), oxidizing agents (e.g., compounds as described in Japanese Patent Application (OPI) No. 260039/85, and *Research Disclosure* No. 16936 (1978)), catechols (e.g., compounds as described in Japanese Patent Application (OPI) Nos. 21013/80 and 65944/80), compounds which release a nucleating agent upon development (e.g., compounds as described in Japanese Patent Application (OPI) No. 107029/85), thioureas (e.g., compounds as described in Japanese Patent Application (OPI) No. 95533/85), and spirobisindans (e.g., compounds as described in Japanese Patent Application (OPI) No. 65944/80).

Various color couplers can be used to form direct positive color images. A useful color coupler in the present invention is a compound which produces or releases a substantially nondiffusible dye upon a coupling reaction with an oxide form of a p-phenylenediamine color developing agent and is substantially nondiffusible itself.

Typical examples of such useful color couplers include naphthol or phenol compounds, pyrazolone or pyrazoloazole compounds, and open-chain or heterocyclic ketomethylene compounds. Specific examples of such cyan, magenta, and yellow couplers which can be used in the present invention are described in the patents cited in Research Disclosure Nos. 17643 (VII-D, Dec. 1978) and 18717 (Nov. 1979).

In particular, typical examples of yellow couplers which can be used in the present invention include oxygen atom-releasing type and nitrogen atom-releasing type two-equivalent yellow couplers. More particularly, α-pivaloylacetanilide couplers are excellent in the fastness of the color forming dye, especially to light. On the other hand, α-benzoylacetanilide couplers provide a high color density and can be preferably used.

Examples of 5-pyrazolone magenta couplers which are preferably used in the present invention include 5-pyrazolone couplers which are substituted by arylamino groups or acylamino groups in the 3-position (particularly sulfur atom-releasing type two-equivalent couplers).

More preferred examples of yellow couplers include pyrazoloazole couplers. In particular, pyrazolo[5,1-c]-[1,2,4]triazole as described in U.S. Pat. No. 3,725,067 are preferably used. Imidazo[1,2-b]pyrazoles as described in U.S. Pat. No. 4,500,630 are more preferably used because their color forming dyes show less yellow side absorption and excellent fastness to light. In this respect, pyrazolo[1,5-b][1,2,4]triazoles as described in U.S. Pat. No. 4,540,654 are further preferable.

Examples of cyan couplers which are preferably used in the present invention include phenol cyan couplers containing an ethyl group or higher alkyl group in the meta-position of the phenol nucleus as described in U.S. Pat. No. 3,772,002. Furthermore, 2,5-diacrylamino-substituted phenol couplers are also preferably used in terms of the fastness of the color image.

Naphthol or phenol couplers as described in U.S. Pat. Nos. 2,474,293 and 4,052,212 are also preferably used in terms of the hue, coupling activity, or fastness of the color image.

Other examples of color couplers which can be used in the present invention are colored couplers for correcting unnecessary absorption of produced dyes in the short wavelength range, couplers whose color forming dyes have a proper diffusibility, colorless couplers, DIR couplers which release a development inhibitor upon a coupling reaction, couplers which release a development accelerator upon a coupling reaction, and polymerized couplers.

The standard amount of such a color coupler to be used is in the range of 0.001 to 1 mol, preferably 0.01 to 0.5 mol for a yellow coupler, 0.003 to 0.3 mol for a magenta coupler, and 0.002 to 0.3 mol for a cyan coupler, per mol of light-sensitive silver halide.

The light-sensitive material prepared in accordance with the present invention may comprise as color fog inhibitor or color stain inhibitor, a derivative of hydroquinone, a derivative of aminophenol, an amine, a derivative of gallic acid, a derivative of catechol, a derivative of ascorbic acid, a colorless coupler, a derivative of sulfonamidophenol, or the like.

The present light-sensitive material may comprise various discoloration inhibitors. Typical examples of organic discoloration inhibitors include hydroquinones, 6-hydroxychromans, 5-hydroxycoumarans, spirochromans, p-alkoxyphenols, hindered phenols such as bisphenols, derivatives of gallic acid, methylenedioxybenzenes, aminophenols, hindered amines, and ether or ester derivatives obtained by silylating or alkylating phenolic hydroxyl groups thereof. Furthermore, metal complexes such as a (bissalicylaldoximate) nickel complex and a (bis-N,N-dialkyldithiocarbamate) nickel complex can be used.

In order to inhibit deterioration of a yellow dye image due to heat, moisture and light, compounds containing both hindered amine and hindered phenol portions in the same molecule as described in U.S. Pat. No. 4,268,593 can be preferably used. In order to inhibit deterioration of a magenta dye image, especially due to light, spiroindans as described in Japanese Patent Application (OPI) No. 159644/81 and hydroquinone- or monoether-substituted chromans as described in Japanese Patent Application (OPI) No. 89835/80 can be preferably used. To this end, these compounds may be coemulsified with the respective color couplers in an amount of 5 to 100% by weight based on the weight of the color couplers and incorporated in the light-sensitive layer. In order to inhibit deterioration of a cyan dye image due to heat and light, especially due to light, it is effective to incorporate an ultraviolet absorber in both adjacent sides of the cyan color forming layer. Furthermore, an ultraviolet absorber can also be incorporated in a hydrophilic colloid layer such as protective layer.

As binder or protective colloids which can be used in the emulsion layer or intermediate layer in the present light-sensitive material there may be advantageously used gelatin. However, other hydrophilic colloids can be used.

The present light-sensitive material may comprise a dye for inhibiting or halation, an ultraviolet absorber, a plasticizer, a fluorescent brightening agent, a matting agent, an air fog inhibitor, a coating aid, a film hardener, an antistatic agent, a lubricant, or the like. Typical examples of such additives are described in Research Disclosure Nos. 17643 (Dec. 1978) and 18716 (Nov. 1979).

The present invention can be applied to a multilayer multicolor photographic materials having at least two spectral sensitivities on a support. In general, a multilayer natural color photographic material has at least one red-sensitive emulsion layer, at least one green-sensitive emulsion layer, and at least one blue-sensitive emulsion layer on a support. The order of arrangement of these sensitive layers can be optionally selected. A preferred example of the order of arrangement is a red-sensitive emulsion layer, a green-sensitive emulsion layer, and a blue-sensitive emulsion layer as viewed from the support or a blue-sensitive emulsion layer, a red-sensitive emulsion layer, and a green-sensitive emulsion layer as viewed from the support. Each of these emulsion layers may comprise two or more emulsion layers having different sensitivities. Alternately, a light-insensitive layer may be interposed between two or more emulsion layers having the same sensitivity. In general, a cyan forming coupler is incorporated in a red-sensitive emulsion layer, a magenta forming coupler is incorporated in a green-sensitive emulsion layer, and a yellow forming coupler is incorporated in a blue-sensitive emulsion layer. However, different combinations may be optionally used.

The present light-sensitive material may optionally comprise auxiliary layers such as a protective layer, an intermediate layer, a filter layer, an antihalation layer, a backing layer, and a white reflection layer besides a silver halide emulsion layer.

In the present photographic light-sensitive material, the photographic emulsion or other layers are coated on a flexible support such as a plastic film, paper, and cloth or a rigid support such as glass, ceramics, and metal. Examples of useful flexible supports include a film made of semisynthetic or synthetic high molecular compounds such as cellulose nitrate, cellulose acetate, cellulose acetobutyrate, polystyrene, polyvinyl chloride, polyethylene terephthalate, and polycarbonate, and paper having a baryta layer of an $\alpha$-olefin polymer (e.g., polyethylene, polypropylene, and ethylene/butene copolymer) coated or laminated thereon. Such a support may be colored with a dye or pigment. Alternatively, such a support may be blackened for the purpose of light screening. The surface of the support is generally undercoated to facilitate adhesion to a photographic emulsion layer or the like. The surface of the support may be subjected to glow discharge, corona discharge, irradiation with ultraviolet light, flame treatment, or the like before or after being undercoated.

The coating of such a silver halide photographic emulsion layer or other hydrophilic colloid layers can be accomplished by various known coating methods such as a dip coating process, a roller coating process, a curtain coating process, and an extrusion coating process.

The present invention can be applied to various color light-sensitive materials.

Examples of such color light-sensitive materials include a color reversal film and a color reversal paper for slide projection or television presentation. The present invention may also be applied to a full color copying machine or a color hard copier for storing CRT images. The present invention can also be applied to a black-and-white light-sensitive material comprising a mixture of three-color couplers as described in Research Disclosure No. 17123 (July 1978).

The color developing solution to be used in development of the present light-sensitive material is a so-called surface developing solution substantially free of a silver halide solvent, preferably an alkaline aqueous solution with a pH of 9.5 to 11.5 containing as a main component a p-phenylenediamine color developing agent. The term "substantially free of a silver halide solvent" as used herein means that a small amount of silver halide solvent may be contained in the developing solution so far as it doe not impair the objects of the present invention. Typical examples of the p-phenylenediamine compound include 3-methyl-4-amino-N,N-diethylaniline, 3-methyl-4-amino-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides, phosphate, p-toluenesulfonates, tetraphenylborates, and p-(t-octyl)benzenesulfonates thereof. These diamines are generally more stable in the form of a salt than in free state.

The color developing agent is generally used in a concentration range of about 0.1 g to 30 g, preferably about 1 g to about 15 g per liter of color developing solution.

The amount of the color developing solution to be used can be reduced by properly adjusting the concentration of halide, color developing agent, or the like.

The present color development time is generally 5 minutes or less but is preferably 2 minutes and 30 seconds or less to speed up the development process. It is more preferably 10 seconds to 2 minutes. If a sufficient color density can be obtained, a shorter development time is desirable.

In order to prevent pollution, the facilitate preservation of alkali metals; a preservative, such as hydroxylamine, triethanolamine, the compounds described in West German Patent Application (OLS) No. 2,633,950, sulfites, or bisulfites; an organic solvent, such as diethylene glycol; a development accelerator, such as benzyl alcohol, polyethylene glycol, quaternary ammonium salt, amines, thiocyanates, or 3,6-thiaoctane-1,3-diol; a brightening agent of the stilbene type or others; dye-forming couplers; a nucleating agent like sodium borohydride; an auxiliary developing agent like 1-phenyl-3-pyrazolidone; a visconsity imparting agent; and a chelating agent, such as aminopolycarboxylic acids represented by ethylenediaminetetraacetic acid, nitrilotriacetic acid, cyclohexanediamine tetraacetic acid, iminodiacetic acid, N-hydroxymethylethylenediaminetriacetic acid, diethylenetriaminepentaacetic acid, triethylenetetraminehexaacetic acid, the compounds described in Japanese Patent Application (OPI) No. 195845/83, and so on, 1-hydroxyethylidene-1,1-diphosphonic acid, organic phosphonic acids described in *Research Disclosure*, No. 18170 (May 1979), aminophosphonic acids like aminotris(methylenephosphonic acid), ethylenediamine-N,N,N'-N'-tetramethylenephosphonic acid, etc., phosphonocarboxylic acids described in Japanese Patent Application (OPI) Nos. 102726/77, 42730/78, 121127/79, 4024/80, 4025/80, and *Research Disclosure*, No. 18170 (May 1979), and so on.

A color developing agent or a precursor thereof may be incorporated in the silver halide color photogrpahic material of the present invention for the purpose of simplification and speedup of photographic processing. Incorporation of a color developing agent in a form of precursor is preferable in respect that it can enhance the stability of the photographic material. Specific examples of developer precursors which can be employed in the present invention include indoaniline compounds as described in U.S. Pat. No. 3,342,597; schiff base type compounds described in U.S. Pat. No. 3,342,599, *Research Disclosure*, No. 13924; metal complex salts described in U.S. Pat. No. 3,719,492; urethane compounds described in Japanese Patent Application (OPI) No. 135628/78; and various salts described in Japanese Patent Application (OPI) Nos. 6235/81, 16133/81, 59232/81, 67842/81, 83734/81, 83735/81, 83736/81, 89735/81, 81837/71, 54430/81, 106241/81, 197236/81, 97531/82 and 83565/82, and so on. The present color developing solution may also comprise a halide ion such as a bromide ion, and an iodide ion, and competing coupler such as citrazinic acid.

After being color-developed, the photographic emulsion layer is generally subjected to bleach. The bleach may be conducted at the same time with fixing in a combined bleach and fixing (blix) process or separately form fixing. In order to further speed up the development process, the blix process may be conducted after bleach or fixing. As the bleaching agent for the bleach or blix process there may be preferably used an organic complex salt or persulfate of iron (III) to speed up the processing and prevent environmental pollution.

Examples of such organic complex salts of iron (III) which can be used because of their high bleaching power include iron (III) complex salts of ethylenediamine tetraacetic acid, diethylenetriamine pentaacetic acid, cyclohexanediamine tetraacetic acid, 1,2-diaminopropane tetraacetic acid, methylimino diacetic acid, 1,3-diaminopropane tetraacetic acid, and glycol ether diamine tetraacetic acid.

Preferred examples of such persulfates include persulfates of an alkali metal such as potassium persulfate and sodium persulfate and ammonium persulfate.

The suitable amount of the bleaching agent to be used is 0.1 to 2 mol per liter of bleaching solution. The suitable pH value of the bleaching solution is in the range of 0.5 to 8.0 if a ferric ion complex salt is used, particularly 4.0 to 7.0 if a ferric ion complex salt of aminopolycarboxylic acid, aminopolyphosphonic acid, phosphonocarboxylic acid, or organic phosphonic acid is used. If a persulfate is used, the concentration of the bleaching agent is 0.1 to 2 mol/l, and the pH value thereof is in the range of 1 to 5.

As the fixing agent for the fixing or blix process there may be used various known fixing agents. Examples of such fixing agents include thiosulfates such as sodium thiosulfate, and ammonium thiosulfate, thiocyanates such as sodium thiocyanate, and ammonium thiocyanate, thioether compounds such as ethylenebisthioglycolic acid, and 3,6-dithia-1,8-octanediol, and water-soluble silver halide solvents such as thioureas. These fixing agents can bae used alone or in combination.

In the bleach or blix process, the concentration of the fixing agent is preferably in the range of 0.2 to 4 mol/l. In the blix process, the concentration of the ferric ion complex salt and fixing agent in 1 l of blix bath are preferably 0.1 to 2 mol and 0.2 to 4 mol, respectively. In general, the pH value of the fixing solution and the blix bath are preferably in the range of 4.0 to 9.0, particularly 5.0 to 8.0.

The present fixing solution or blix bath may comprise as a preservative, a sulfite such as sodium sulfite, potassium sulfite, and ammonium sulfite, bisulfite, hydroxylamine, hydrazine, a bisulfite addition product of an aldehyde compound such as sodium acetaldehyde bisulfite, or the like besides the above mentioned additives which can be incorporated in the bleaching solution. The present fixing solution or blix bath may further contain various fluorescent brightening agents, antifoaming agents, surface active agents, or organic solvents such as polypyrrolidone, and methanol.

Any suitable bleach accelerators can be optionally used in the bleaching solution, blix bath, and their prebaths. Specific examples of such useful bleach accelerators include compounds containing mercapto groups or disulfide groups, thiazolidine derivatives, thiourea derivatives, iodides, polyethylene oxides, polyamines, compounds as described in Japanese Patent Application (OPI) Nos. 42434/74, 59644/74, 94927/78, 35727/79, 26506/80, and 163940/83, iodine ions, and bromine ions. In particular, such compounds containing mercapto groups or disulfide groups are preferably used because of their great effect of accelerating bleach. More particularly, compounds as described in U.S. Pat. No. 3,893,858, West German Patent No. 1,290,812, and Japanese Patent Application (OPI) No. 95630/78 are preferably used. Furthermore, compounds as described in U.S. Pat. No. 4,552,834 are preferably used. These bleach accelerators may be incorporated in the light-sensitive material.

In general, the fixing process or blix process is followed by processing steps such as rinsing and stabilization.

In order to inhibit precipitation or stabilize the rinsing water, various known compounds may be incorporated in the rinsing process and the stabilizing process. For example, chelating agents such as inorganic phosphoric acid, aminopolycarboxylic acid, and organic phosphonic acid, antibacterial and antifungal agents for inhibiting generation of various bacteria, algae, or molds (e.g., compounds as described in *Journal of Antibacterial and Antifungal Agents*, 11, No. 5, pp. 207–233 (1983)) and *Chemistry of Antibacteria and Antifungi* (edited by Hiroshi Horiguchi), magnesium salts, aluminum salts, bismuth salts, and other metal salts, alkali metal and ammonium salts, or surface active agents for preventing dry load or unevenness may be optionally incorporated in these processes. Alternatively, compounds as described in West, *Photographic Science and Engineering*, 6, pp. 344–359 (1965) may be used. Particularly, chelating agents, antibacterial agents or antifungal agents are effectively used.

The rinsing process is generally conducted in the manner of multistage countercurrent rinsing using two or more tanks (e.g., 2 to 9 tanks) to save rinsing water. The rinsing process may be replaced by a multistage countercurrent stabilizing process as described in Japanese Patent Application (OPI) No. 8543/82. In order to stabilize the image, the present stabilizing bath may comprise various compounds besides the above-mentioned additives. Typical examples of such additives include various buffers for adjusting the pH of the film (e.g., 3 to 9) such as combinations of borates, methaborates, borax, phosphates, carbonates, potassium hydroxide, sodium hydroxide, ammonia water, monocarboxylic acid, dicarboxylic acid, and polycarboxylic acid), and aldehydes such as formaldehyde. Other examples of such additives include chelating agents such as inorganic phosphoric acid, aminopolycarboxylic acid, organic phosphonic acid, aminopolyphosphonic acid, and phosphono carboxylic acid, antibacterial agents, antifungal agents such as thiazoles, isothiazoles, halogenated phenol, sulfanilamide, and benzotriazole, surface active agents, fluorescent brightening agents, and metal salts of a film hardener. Two or more such compounds of the same or different objects may be used, alone or in combination.

In order to improve image stability, various ammonium salts such as ammonium chloride, ammonium nitrate, ammonium sulfate, ammonium phosphate, ammonium sulfite, and ammonium thiosulfate can be incorporated in the process as a pH adjustor for the processed film.

The present rinsing and stabilizing time depends on the type of light-sensitive material and the processing conditions but is generally in the range of 20 seconds to 10 minutes, preferably 20 seconds to 5 minutes.

In the present invention, various processing solutions are used at a temperature of 10° C. to 50° C. The standard temperature range is 33° to 38° C. However, a higher temperature range can be used to accelerate processing, thereby shortening the processing time. On the contrary, a lower temperature range can be used to improve the picture quality or the stability of the processing solutions.

Each processing time can be shorter than the standard time so long as it does not impede the processing in order to speed up the processing.

In a continuous processing step, a replenishing solution for each processing solution can be used to inhibit variation in the composition of the processing solution so that a constant finish can be obtained.

Each processing bath may be optionally provided therein with a heater, temperature sensor, level sensor, circulating pump, filter, various floating covers, various squeegees, and like devices.

The process of the present invention can be applied to not only color image formation but also black-and-white image formation. In the blue-and-white image formation, various developing agent can be used. Suitable examples of such developing agent include polyhydroxybenzenes such as hydroquinone, 2-chlorohydroquinone, 2-methylhydroquinone, catechol, pyrogallol, etc.; aminophenols such as p-amino-phenol, N-methyl-p-aminophenol, 2,4-diaminophenol, etc.; 3-pyrazolidones such as 1-phenyl-3-pyrazolidone, 4,4-dimethyl-1-phenyl-3-pyrazolidone, 5,5-dimethyl-1-phenyl-3-pyrazolidone, etc.; ascorbic acid, etc. They can be used singly or in combination.

The developing solution may contain a preservative such as sodium sulfite, potassium sulfite, ascorbic acid, reductions (e.g., piperidinohexose reduction), etc.

The pH of the developing solution is 9.0 or more, preferably 9.5 to 11.5 as in the case of the color developing solution.

The present invention will be further illustrated in the following examples, but the present invention should not be construed as being limited thereto.

Emulsions A, B, C and D were prepared for the present examples as follows:

EMULSION A

An aqueous solution of potassium bromide (0.5 mol/l) and an aqueous solution of silver nitrate (0.5 mol/l) were added at the same time to an aqueous solution of 3 (w/v) % gelatin comprising 50 mg of 3,4-dimethyl-1,3-thiazolidine-2-thione per mol of Ag at a temperature of 75° C. with vigorous stirring for about 20 minutes to obtain a monodisperse emulsion of octahedron silver halide grain having an average particle size of 0.4 μm. Sodium thiosulfate and chloroauric acid (tetrahydrate) were each added to the emulsion thus obtained in amounts of 6 mg per mol of silver. The admixture was heated to a temperature of 75° C. for 80 minutes so that the emulsion was chemically sensitized. A further crystal growth was made by subjecting the emulsion to the processing under the same precipitation condition as the first precipitation condition with the silver bromide grains thus obtained as core. As a result, a monodisperse emulsion of octahedron core/shell silver bromide grains having an average particle diameter of 0.7 μm was obtained. After the emulsion was rinsed and desalted, sodium thiosulfate and chloroauric acid (tetrahydrate) were each added thereto in an amount of 1.5 mg per mol of silver. The admixture was then heated at a temperature of 60° C. for 60 minutes so that the emulsion was chemically sensitized to obtain an internal latent image type silver halide emulsion A.

EMULSION B 30 g of gelatin was dissolved in 1 l of a mixed solution of 0.5 mol/l of KBr, 0.2 mol/l of NaCl, and 0.0015 mol/l of KI. 700 ml of a solution of 1 mol/l of silver nitrate was added to the admixture at a temperature of 60° C. in 20 minutes. The admixture was subjected to physical ripening for 20 minutes.

The emulsion was then rinsed with water to remove water-soluble halides therefrom. 20 g of gelatin was added to the emulsion. Water was added to the emulsion to make 1,200 ml. As a result, an emulsion of silver halide grains having an average particle diameter of 0.4 μm was obtained.

500 ml of an aqueous solution of 1 mol/l of silver nitrate and 500 ml of an aqueous solution of 2 mol/l of sodium chloride were added at the same time to 300 ml of the emulsion thus obtained at a temperature of 60° C. so that silver chloride shells were precipitated. The emulsion was rinsed with water. As a result, an emulsion B of silver halide having an average particle diameter of 0.7 μm was obtained.

EMULSION C

An aqueous solution of potassium bromide (0.5 mol/l) and an aqueous solution of silver nitrate (0.5 mol/l) were added at the same time to an aqueous solution of 3 (w/v) % gelatin at a temperature of 75° C. with vigorous stirring in about 90 minutes to obtain an emulsion of octahedron silver bromide grains having an average particle diameter of about 0.8 μm (core grains). Before the silver halide grains had been precipitated in the emulsion, 0.65 g f 3,4-dimethyl-1,3-thiazoline-2-thione was added to the aqueous solution of gelatin so that the pH and pAg thereof were maintained at about 6 and about 8.7, respectively, during the precipitation. Sodium thiosulfate and potassium chloroaurate were each added to the silver halide grains in an amount of 3.4 mg per mol of sivler so that the emulsion was chemically sensitized. A further crystal growth was made with the grains as cores under the same precipitation condition as that used in the core grain formation. As a result, octahedron core/shell silver bromide grains having an average particle diameter of 1.2 μm was formed. Potassium iodide and N-vinylpyrrolidone polymer (weight average molecular weight: 38,000) were added to the silver bromide grains in amounts of $9.6\times10^{-4}$ mol/mol of silver and $4.2\times10^{-2}$ g/mol of Ag, respectively, to obtain an emulsion C.

EMULSION D

An aqueous solution of potassium bromide (0.5 mol/l) and an aqueous solution of silver nitrate (0.5 mol/l) were added at the same time to an aqueous solution of 3 (w/v) % gelatin containing potassium bromide (0.05 mol/l) at a temperature of 75° C. with vigorous stirring in about 60 minutes to obtain a silver bromide emulsion. Before the precipitation (simultaneous mixing) was made, 3,4-dimethyl-1,3-thiazoline-2-thione and benzimidazole were added as silver halide solvent to the aqueous solution of gelatin in amounts of 150 mg and 15 g per mol of silver, respectively. When the precipitation was completed, octahedron silver bromide crystals having uniform sizes and an average particle diameter of about 0.8 μm were formed. Sodium thiosulfate and potassium chloroaurate were added to the silver bromide grains in amounts of 4.8 mg and 2.4 mg per mol of silver, respectively. The admixture was then heated to a temperature of 75° C. for 80 minutes so that it was chemically sensitized. An aqueous solution of potassium bromide and an aqueous solution of silver nitrate were added to the core silver bromide emulsion thus chemically sensitized at the same time in 45 minutes in the same manner as in the first simultaneous mixing so that an internal latent image type core/shell silver bromide emulsion was precipitated. Hydrogen peroxide was added as an oxidizing agent to the emulsion in an amount of 2.5 g/mol Ag. The admixture was heated to a temperature of 75° C. for 8 minutes. The emulsion was rinsed to obtain an emulsion of silver bromide grains having an average particle diameter of 1.0 μm.

Sodium thiosulfate and poly(N-vinylpyrrolidone) were added to the internal latent image type core/shell silver bromide emulsion in amounts of 0.75 mg and 20 mg per mol of silver, respectively. The emulsion was then heated to a temperature of 60° C. for 60 minutes so that the surface of the grains were chemically sensitized (ripened) to obtain an emulsion D.

EXAMPLE 1

A coating solution prepared as described below was coated on a paper support comprising polyethylene laminated on both sides thereof to prepare color photographic paper samples Nos. 1 to 31.

PREPARATION OF COATING SOLUTION

Ethyl acetate and solvent (g) were put into a container containing magenta coupler (e) and color image stabilizer (f) so that (a) and (b) were dissolved in (c). The solution thus obtained was emulsified in a 10 (w/v)

% aqueous solution of gelatin containing 10 (w/v) % sodium dodecylbenzenesulfonate. The emulsion and the above mentioned core/shell type internal latent image silver halide emulsion A (containing a green-sensitive dye ($3.5\times10^{-4}$ mol/mol Ag) and an anti-irradiation dye (0.02 g/m$^2$)) were mixed so that dissolution was made. The concentration of the emulsion was adjusted with gelatin so that the composition shown in Table 1 was obtained. A nucleating agent (the above-mentioned Compound 65) and a nucleation accelerator described in Table 2 were added to the emulsion in amounts of $3.9\times10^{-5}$ mol and $4.2\times10^{-4}$ mol per mol of silver, respectively.

The coating solutions thus prepared were coated on a polyethylene-laminated paper. At the same time, an ultraviolet absorbing layer having the composition described below was coated on the coated layer. A protective layer having the composition described below was then coated on the ultraviolet absorbing layer.

| | |
|---|---|
| Ultraviolet absorbing layer | |
| Gelatin | 1.60 g/m$^2$ |
| Colloidal silver | 0.10 g/m$^2$ |
| Protective layer | |
| Gelatin | 1.33 g/m$^2$ |
| Acryl-modified copolymer of polyvinyl alcohol (degree of modification: 17%; molecular weight: 20,000) | 0.17 g/m$^2$ |

TABLE 1

Composition of Green-Sensitive Layer

| Main Component | Used Amount |
|---|---|
| Emulsion A | 0.39 g/m$^2$ (in terms of amount of silver) |
| Gelatin | 1.45 g/m$^2$ |
| Magenta coupler (e) | $4.6\times10^{-4}$ mol/m$^2$ |
| Color image stabilizer (f) | 0.14 g/m$^2$ |
| Solvent (g) | 0.42 g/m$^2$ |
| Nucleating agent (Compound 65) | $3.9\times10^{-5}$ mol/mol Ag |
| Nucleating accelerators (shown in Table 2) | $4.2\times10^{-4}$ mol/mol Ag |

Green-sensitive Dye

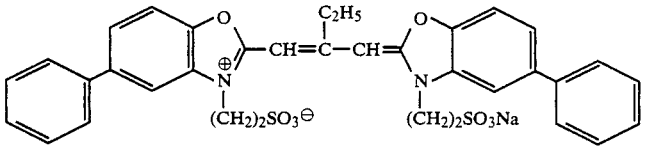

Anti-irradiation Dye for Green-Sensitive Emulsion Layer

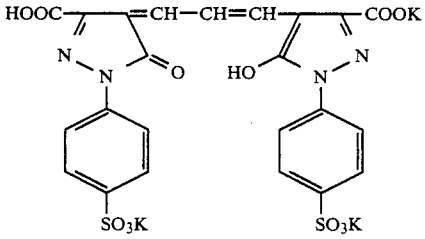

(e)

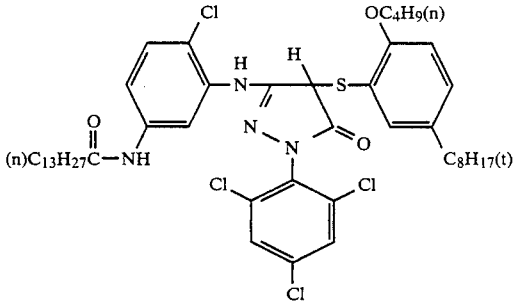

(f) A 1:1.5 (by weight) mixture of

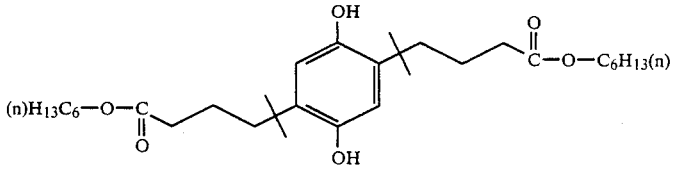

and

TABLE 1-continued

| Composition of Green-Sensitive Layer | |
|---|---|
| Main Component | Used Amount |
| 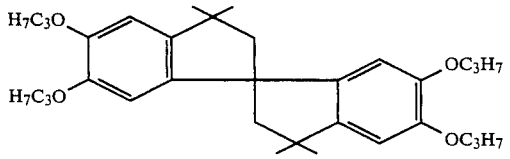 | |
| (g) A 1:2:2 (by weight) mixture of 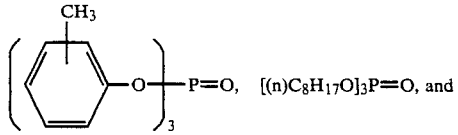 $[(n)C_8H_{17}O]_3P{=}O$, and 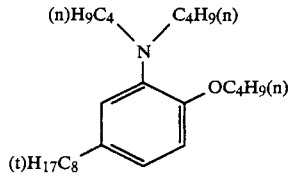 | |

The color photographic paper samples thus prepared were wedgewise exposed to light through a green filter (SP-2 of Fuji Photo Film Co., Ltd.) for 1/10 second at 10 CMS. These samples were then subjected to processing steps A (pH of color developing solution: 10.2), B (pH of color developing solution: 11.2) and C (pH of color developing solution: 12.0) described below. These samples were measured

| Processing Step A | Time | Temperature |
|---|---|---|
| Color Development | 3 min. 30 sec. | 33° C. |
| Blxi- | 40 sec. | 33° C. |
| Stabilization 1 | 20 sec. | 33° C. |
| Stabilization 2 | 20 sec. | 33° C. |
| Stabilization 3 | 20 sec. | 33° C. |

The process for replenishing the stabilizing baths was accomplished by the so-called countercurrent replenishing process. In the replenishing process, stabilizing bath 3 was first replenished. The overflow solution from stabilizing bath 3 was introduced into stabilizing bath 2. The overflow solution from stabilizing bath 2 was then introduced into stabilizing bath 1.

| Color Developing Solution | Mother Liquor |
|---|---|
| Diethylenetriamine pentaacetic Acid | 2.0 g |
| Benzyl Alcohol | 12.8 g |
| Diethylene Glycol | 3.4 g |
| Sodium Sulfite | 2.0 g |
| Sodium Bromide | 0.26 g |
| Hydroxylamine Sulfate | 2.60 g |
| Sodium Chloride | 3.20 g |
| 3-Methyl-4-amino-N-ethyl-N-(β-methanesulfonamidoethyl)aniline | 4.25 g |
| Potassium Carbonate | 30.0 g |
| Fluorescent brightening agent (stilbene series) | 1.0 g |
| Water to make | 1,000 ml |
| pH | 10.20 |

The pH value of the solution was adjusted with potassium hydroxide or hydrochloric acid.

| Blix Solution | Mother Liquor |
|---|---|
| Ammonium Thiosulfate | 110 g |
| Sodium Hydrogensulfite | 10 g |
| Iron (III) Ammonium Diethylenetriamine pentaacetate (monohydrate) | 56 g |
| Disodium Ethylenediamine Tetraacetate (dihydrate) | 5 g |
| 2-Mercapto-1,3,4-triazole | 0.5 g |
| Water to make | 1,000 ml |
| pH | 6.5 |

The pH value of the solution was adjusted with ammonia water or hydrochloric acid.

| Stabilizing Solution | Mother Liquor |
|---|---|
| 1-Hydroxyethylidene-1,1'-diphosphonic Acid (60 (v/v)%) | 1.6 ml |
| Bismuth Chloride | 0.35 g |
| Polyvinyl pyrrolidone | 0.25 g |
| Aqueous Ammonia | 2.5 ml |
| Trisodium Nitrilotriacetate | 1.0 g |
| 5-Chloro-2-methyl-4-isothiazoline-3-one | 50 mg |
| 2-Octyl-4-isothiazoline-3-one | 50 mg |
| Fluorescent brightening agent (4,4'-diaminostilbene series) | 1.0 g |
| Water to make | 1,000 ml |
| pH | 7.5 |

The pH value of the solution was adjusted with potassium hydroxide or hydrochloric acid.

Processing step B was conducted in the same as in processing step A except that the color development time was 1 minute and 30 seconds and the pH value of the processing solution was adjusted to 11.2.

Processing step C was conducted in the same manner as in processing step B except that the pH value of the color developing solution was adjusted to 12.0.

The results are shown in Table 2.

TABLE 2

| No. | Nucleation Accelerator | Processing Step A Dmax | Processing Step A Dmin | Processing Step B Dmax | Processing Step B Dmin | Processing Step C Dmax | Processing Step C Dmin |
|---|---|---|---|---|---|---|---|
| 1 | *1 | 2.0 | 0.08 | 2.1 | 0.09 | 1.9 | 0.10 |
| 2 | 2 | 2.1 | 0.08 | 2.2 | 0.09 | 2.1 | 0.11 |
| 3 | 89 | 2.1 | 0.09 | 2.2 | 0.10 | 2.1 | 0.11 |
| 4 | 4 | 1.9 | 0.09 | 2.0 | 0.10 | 2.0 | 0.11 |
| 5 | 5 | 2.1 | 0.08 | 2.2 | 0.09 | 2.1 | 0.10 |
| 6 | 6 | 2.2 | 0.09 | 2.3 | 0.10 | 2.1 | 0.11 |
| 7 | 8 | 2.1 | 0.08 | 2.2 | 0.10 | 2.0 | 0.11 |
| 8 | 13 | 2.2 | 0.09 | 2.2 | 0.10 | 2.0 | 0.11 |
| 9 | 99 | 1.9 | 0.09 | 1.9 | 0.10 | 1.8 | 0.11 |
| 10 | 95 | 1.7 | 0.10 | 1.8 | 0.11 | 1.7 | 0.12 |
| 11 | 20 | 2.2 | 0.08 | 2.2 | 0.09 | 2.1 | 0.11 |
| 12 | 25 | 1.9 | 0.09 | 1.9 | 0.10 | 1.8 | 0.11 |
| 13 | 26 | 2.2 | 0.08 | 2.3 | 0.08 | 2.2 | 0.10 |
| 14 | 28 | 2.1 | 0.09 | 2.2 | 0.09 | 2.1 | 0.10 |
| 15 | 29 | 1.9 | 0.09 | 2.0 | 0.10 | 2.0 | 0.11 |
| 16 | 30 | 2.0 | 0.09 | 2.1 | 0.11 | 2.0 | 0.12 |
| 17 | 31 | 1.9 | 0.09 | 1.9 | 0.11 | 1.8 | 0.12 |
| 18 | 35 | 2.2 | 0.08 | 2.3 | 0.09 | 2.2 | 0.10 |
| 19 | 103 | 2.1 | 0.08 | 2.2 | 0.09 | 2.1 | 0.10 |
| 20 | 42 | 2.1 | 0.08 | 2.2 | 0.09 | 2.1 | 0.10 |
| 21 | 50 | 2.0 | 0.08 | 2.1 | 0.09 | 2.0 | 0.11 |
| 22 | 56 | 2.1 | 0.09 | 2.2 | 0.10 | 2.1 | 0.11 |
| 23 | 62 | 1.9 | 0.09 | 2.0 | 0.10 | 1.9 | 0.12 |
| 24 | 67 | 1.8 | 0.09 | 1.9 | 0.10 | 1.9 | 0.11 |
| 25 | 69 | 1.8 | 0.09 | 1.9 | 0.10 | 1.9 | 0.11 |
| 26 | 70 | 1.9 | 0.08 | 1.9 | 0.10 | 1.9 | 0.12 |
| 27 | 72 | 1.8 | 0.09 | 1.9 | 0.11 | 1.8 | 0.12 |
| 28 | 83 | 1.6 | 0.10 | 1.7 | 0.12 | 1.7 | 0.11 |
| 29 | none | 0.3 | 0.14 | 0.9 | 0.17 | 1.3 | 0.15 |

*The compound number of previously described nucleation accelerators.

The results shown in Table 2 demonstrate that the systems using the present nucleation accelerators provide greater maximum magenta color densities (Dmax) and smaller minimum magenta color densities (Dmin) than the systems which does not use the present nucleation accelerators.

EXAMPLE 2

Full multilayer color photographic paper samples having the layer structures shown in Table 3 provided on a paper support comprising polyethylene laminated on both sides thereof were prepared by using the core/-shell type internal latent image emulsion B.

PREPARATION OF COATING SOLUTION FOR THE 1ST LAYER 10 ml of ethyl acetate and 4 ml of solvent (c) were added to 10 g of cyan coupler (a) and 2.3 g of color image stabilizer (b) so that the (a) and (b) were dissolved in (c). The resulting solution was emulsified in 90 ml of a 10 (w/v) % aqueous solution of gelatin containing 5 ml of 10 (w/v) % sodium dodecylbenzenesulfonate. On the other hand, a red-sensitive dye shown hereinafter was added to the above mentioned silver halide emulsion B (containing 70 g/Kg of Ag) in an amount of $2.0\times10^{-4}$ mol per mol of silver halide to prepare 90 g of a red-sensitive emulsion. The above emulsion dispersion and the red-sensitive emulsion thus obtained were mixed so that dissolution was made. The concentration of the solution was adjusted with gelatin so that the composition shown in Table 3 was obtained. Furthermore, a nucleating agent (the above-mentioned Compound 50) and a nucleation accelerator shown in Table 4 were added to the emulsion in amounts $4.0\times10^{-5}$ mol and $3.0\times10^{-4}$ mol per mol of Ag, respectively, to prepare a coating solution for the 1st layer.

Coating solutions for the 2nd layer to the 7th layer were prepared in the same manner as in the 1st layer except that the blue-sensitive dye below ($3.5\times10^{-4}$ mol/mol Ag) was used instead of the red-sensitive dye. As a gelatin hardener for each layer there was used a sodium salt of 1-oxy-3,5-dichloro-s-triazine (1 wt. % based on the weight of gelatin.

As spectral sensitizer for each emulsion there was used the following compound.

TABLE 3

| Layer | Main Components | Used Amount |
|---|---|---|
| 7th Layer (Protective layer) | Gelatin | 1.33 g/m$^2$ |
| | Acryl-modified copolymer of polyvinyl alcohol (degree of modification: 17% molecular weight: 20,000) | 0.17 g/m$^2$ |
| 6th Layer (Ultra-violet absorbing layer) | Gelatin | 0.54 g/m$^2$ |
| | Ultaviolet absorber (h) | $5.10\times10^{-4}$ mol/m$^2$ |
| | Solvent (j) | 0.08 g/m$^2$ |
| 5th Layer (Blue-Sensitive layer) | Emulsion B | 0.40 g/m$^2$ (in terms of amount of silver) |
| | Gelatin | 1.35 g/m$^2$ |
| | Yellow coupler (k) | $6.91\times10^{-4}$ mol/m$^2$ |
| | Color image stabilizer (l) | 0.13 g/m$^2$ |
| | Solvent (m) | 0.02 g/m$^2$ |
| | Nucleating agent and nucleation accelerator | |
| 4th Layer (Ultra-violet absorbing layer) | Gelatin | 1.60 g/m$^2$ |
| | Colloidal silver | 0.10 g/m$^2$ |
| | Ultraviolet absorber (h) | $1.70\times10^{-4}$ mol/m$^2$ |
| | Color stain inhibitor (i) | $1.60\times10^{-4}$ mol/m$^2$ |
| | Solvent (j) | 0.24 g/m$^2$ |
| 3rd Layer (Green-sensitive layer) | Emulsion B | 0.39 g/m$^2$ (in terms of amount of silver) |
| | Gelatin | 1.45 g/m$^2$ |
| | Magenta coupler (e) | $4.60\times10^{-4}$ *mol/m2* |
| | Color image stabilizer (f) | 0.14 g/m$^2$ |
| | Solvent (g) | 0.42 g/m$^2$ |
| | Nucleating agent and nucleation accelerator | |
| 2nd Layer (Color stain inhibiting layer | Gelatin | 0.90 g/m$^2$ |
| | Color stain inhibitor (d) | $2.33\times10^{-4}$ mol/m$^2$ |
| 1st Layer (Red-sensitive layer) | Emulsion B | 0.39 g/m$^2$ (in terms of amount of silver) |
| | Gelatin | 0.90 g/m$^2$ |
| | Cyan coupler (a) | $7.05\times10^{-4}$ mol/m$^2$ |
| | Color image stabilizer (b) | $5.20\times10^{-4}$ mol/m$^2$ |
| | Solvent (c) | 0.22 g/m$^2$ |
| | Nucleating agent and nucleation accelerator | |
| Support | Polyethylene-laminated paper (containing a white pigment ($TiO_2$) and a blue dye (ultra-marine) | |

The magenta coupler (e), color image stabilizer (f), solvent (g), green-sensitive sensitizing dye, and anti-irradiation dye used in the third layer were the same as described with reference to Example 1. The other additives used were as follows:

Blue-sensitive Emulsion Layer (blue-sensitive dye)

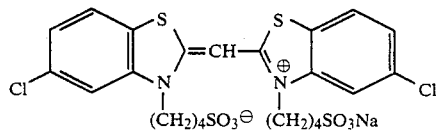

Red-sensitive Emulsion Layer (red-sensitive dye)

-continued

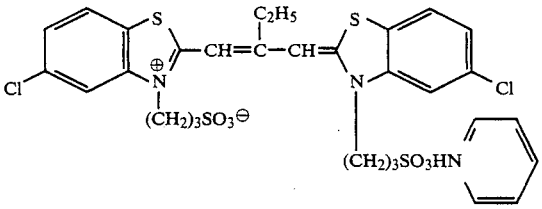

As the anti-irradiation dye for the red-sensitive emulsion layer, there was used the following dye (3 g/m$^2$):
Anti-irradiation dye for red-sensitive emulsion layer:

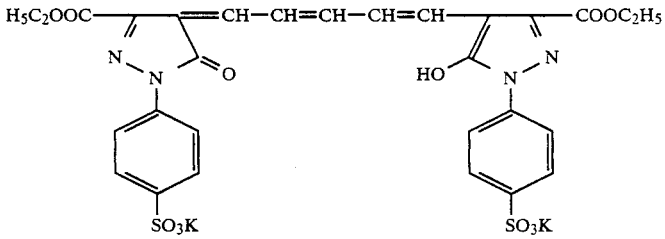

the structural formula of the compounds used in the example such as couplers are as follows:

(k) Yellow Coupler

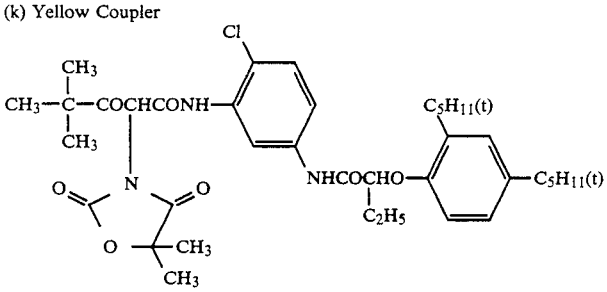

(l) Color Image Stabilizer

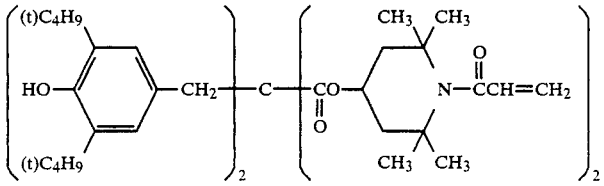

(h) Ultraviolet Absorber
1:5:3 mixture (molar proportion) of

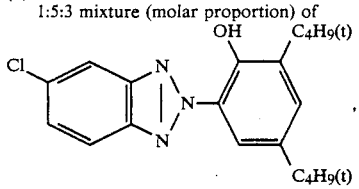

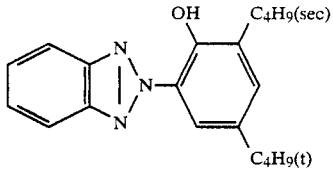

and

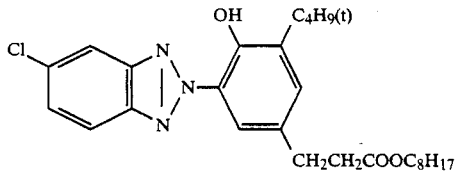

(i) Color Stain Inhibitor

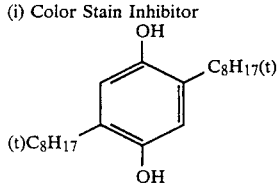

(j) Solvent
$(iso\text{-}C_9H_{19}O)_3P{=}O$

-continued (m) Solvent
$(iso\text{-}C_9H_{19}O)_3P{=}O$ (a) Cyan Coupler

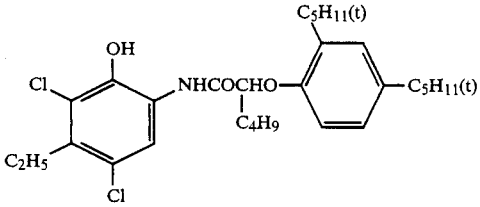

(b) Color Image Stabilizer
1:3:3 mixture (molar proportion) of

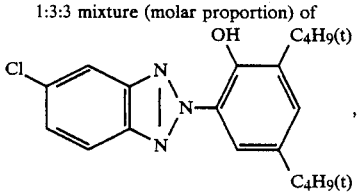

,

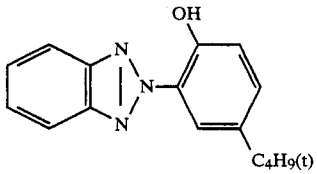

and

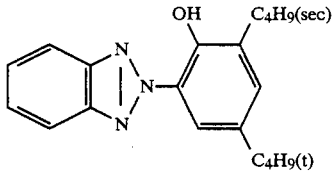

(c) Solvent

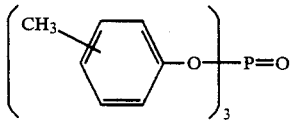

(d) Color Stain Inhibitor

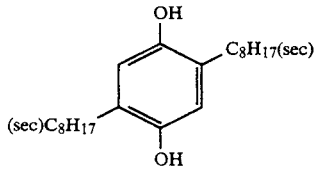

The coating solutions for the 1st layer to the 7th layer were adjusted for proper balance between surface tension and viscosity. These coating solutions were then coated on the support at the same time to prepare full multilayer color photographic paper samples.

The color photographic paper sample Nos. 1 to 11 thus obtained were then exposed to light and developed in the same manner as in Example 1. The results obtained on the magenta color image are shown in Table 4.

TABLE 4

| No. | Nucleation Accelerator | Processing Step A | | Processing Step B | | Processing Step C | |
|---|---|---|---|---|---|---|---|
| | | $D_{max}$ | $D_{min}$ | $D_{max}$ | $D_{min}$ | $D_{max}$ | $D_{min}$ |
| 1 | 2 | 2.0 | 0.08 | 2.1 | 0.09 | 1.9 | 0.09 |
| 2 | 1 | 2.1 | 0.09 | 2.2 | 0.10 | 2.1 | 0.11 |
| 3 | 13 | 2.1 | 0.09 | 2.2 | 0.09 | 2.1 | 0.10 |
| 4 | 28 | 2.2 | 0.09 | 2.3 | 0.10 | 2.2 | 0.11 |
| 5 | 34 | 2.1 | 0.09 | 2.2 | 0.10 | 2.2 | 0.10 |
| 6 | 42 | 2.0 | 0.08 | 2.1 | 0.09 | 2.0 | 0.10 |

TABLE 4-continued

| No. | Nucleation Accelerator | Processing Step A | | Processing Step B | | Processing Step C | |
|---|---|---|---|---|---|---|---|
| | | $D_{max}$ | $D_{min}$ | $D_{max}$ | $D_{min}$ | $D_{max}$ | $D_{min}$ |
| 7 | 43 | 2.2 | 0.09 | 2.3 | 0.09 | 2.1 | 0.11 |
| 8 | 46 | 1.9 | 0.09 | 2.0 | 0.10 | 1.9 | 0.11 |
| 9 | 56 | 2.0 | 0.09 | 2.1 | 0.10 | 2.0 | 0.11 |
| 10 | 62 | 1.9 | 0.09 | 2.0 | 0.10 | 2.0 | 0.11 |
| 11 | None | 0.4 | 0.13 | 1.1 | 0.14 | 1.5 | 0.15 |

The results in Table 4 show that the full multilayer color photographic papers comprising a red-sensitive emulsion layer, a green-sensitive emulsion layer, and a blue-sensitive emulsion layer coated thereon can provide the same effects as obtained in Example 1.

EXAMPLE 3

Sample Nos. 1 to 8 were prepared in the same manner as in Example 2 except that the following changes were made:

Changes:

| | | |
|---|---|---|
| (1) | Internal latent image emulsion | Above mentioned emulsion C |
| (2) | Nucleating agent | Compound 9 ($3 \times 10^{-5}$ mol/mol Ag) |
| (3) | Nucleation accelerator | Shown in Table 5 |
| (4) | 3rd layer (green-sensitive layer) | as follows: |
| | Main Components | Used Amount |
| | Emulsion C | 0.17 g/m$^2$ (in terms of amount of silver) |
| | Gelatin | 1.56 g/m$^2$ |
| | Magenta coupler (e') | $3.38 \times 10^{-4}$ mol/m$^2$ |
| | Color image stabilizer (f') | 0.19 g/m$^2$ |
| | Nucleating agent and nucleation accelerator | |
| | Solvent (g') | 0.59 g/m$^2$ |
| (5) | Yellow coupler (k') | see below |
| (6) | Cyan coupler (a') | see below |

(e')

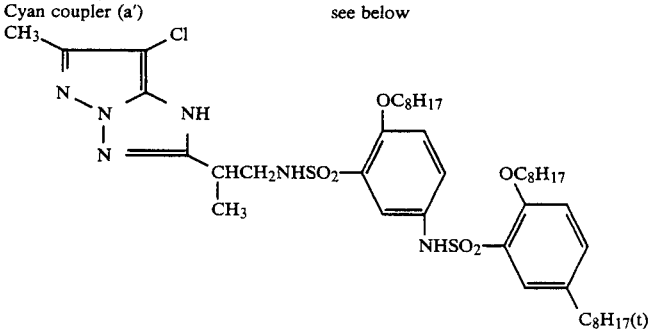

(f') Color image stabilizer

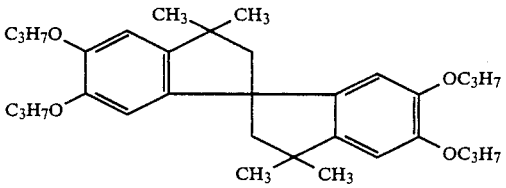

(g') Solvent

2:1 mixture (weight proportion) of $((n)C_8H_{17}O)_3P{=}O$ and

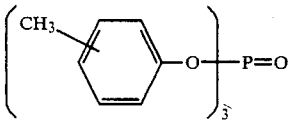

(k') Yellow coupler

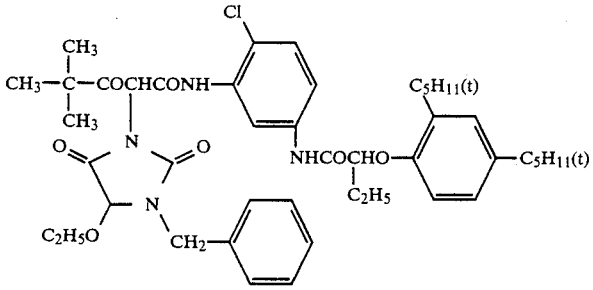

(a') Cyan coupler

1:1 mixture (molar proportion) of

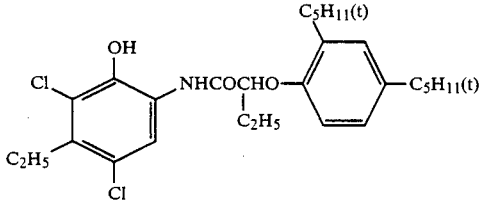

-continued and

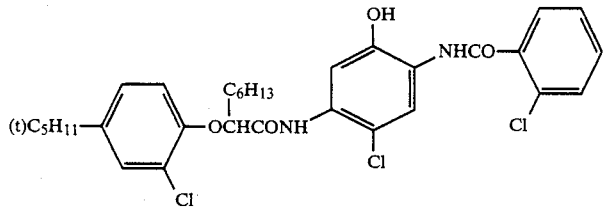

The color photographic paper sample Nos. 1 to 8 thus obtained were wedgewise exposed to light through a red filter. These samples were then subjected to the same processing steps a and B as in Example 1 except that the color development was conducted at a temperature of 35° C. for 2 minutes and 1 minute, respectively. These samples were measured for cyan color image density.

The results are shown in Table 5.

TABLE 5

| No. | Nucleation Accelerator | Processing Step A Dmax | Processing Step A Dmin | Processing Step B Dmax | Processing Step B Dmin |
|---|---|---|---|---|---|
| 1 | 2 | 2.1 | 0.09 | 2.2 | 0.10 |
| 2 | 13 | 2.0 | 0.09 | 2.1 | 0.10 |
| 3 | 62 | 2.2 | 0.08 | 2.2 | 0.09 |
| 4 | 89 | 2.1 | 0.09 | 2.0 | 0.10 |
| 5 | 42 | 2.1 | 0.09 | 2.0 | 0.10 |
| 6 | 70 | 2.0 | 0.09 | 2.0 | 0.10 |
| 7 | 56 | 2.1 | 0.08 | 1.9 | 0.09 |
| 8 | none | 0.6 | 0.11 | 1.2 | 0.13 |

The results in Table 5 show that the present samples can provide the same results in cyan color image density as in Example 1.

EXAMPLE 4

Single-layer color photographic paper sample Nos. 1 to 8 having the green-sensitive layer in Example 3, the 4th layer (ultraviolet absorbing layer), and the 7th layer (protective layer) coated thereon were prepared in the same manner as in Example 1 except that the following changes were made:

| Changes: | |
|---|---|
| (1) Internal latent image type emulsion | Above mentioned emulsion D |
| (2) Nucleation accelerator | $3 \times 10^{-6}$ mol per liter of color developing solution |
| (3) Nucleating agent | Above-mentioned Compound 55 ($3 \times 10^{-5}$ mol/mol Ag) |

The color photographic paper samples thus obtained were wedgewise exposed to light through a green filter. These samples were then subjected to the same processing steps B and C except that the development was conducted at a temperature of 35° C. for 2 minutes and 30 seconds. These samples were then measured for magenta color image density.

The results are shown in Table 6.

TABLE 6

| No. | Nucleation Accelerator | Processing Step A Dmax | Processing Step A Dmin | Processing Step B Dmax | Processing Step B Dmin | Processing Step C Dmax | Processing Step C Dmin |
|---|---|---|---|---|---|---|---|
| 1 | 2 | 1.9 | 0.12 | 1.9 | 0.12 | 1.8 | 0.14 |
| 2 | 6 | 1.8 | 0.11 | 1.9 | 0.12 | 1.8 | 0.14 |
| 3 | 7 | 2.0 | 0.11 | 2.1 | 0.12 | 2.0 | 0.13 |
| 4 | 18 | 2.0 | 0.12 | 2.2 | 0.12 | 2.1 | 0.13 |
| 5 | 103 | 2.1 | 0.11 | 2.0 | 0.12 | 1.9 | 0.14 |
| 6 | 42 | 1.9 | 0.11 | 1.9 | 0.12 | 1.9 | 0.14 |
| 7 | 56 | 1.8 | 0.11 | 2.0 | 0.12 | 1.9 | 0.14 |
| 8 | none | 0.5 | 0.14 | 0.8 | 0.14 | 1.4 | 0.16 |

The results in Table 6 show that the samples comprising the present nucleation accelerators all provide greater maximum magenta color image densities (Dmax) than the samples free of the present nucleation accelerators.

EXAMPLE 5

Compound 9 was added as a nucleating agent to the above mentioned emulsion A in an amount of $4.7 \times 10^{-5}$ mol per mol of silver halide. Nucleation accelerators were each added to the emulsion as shown in Table 7. The emulsion was then coated on a polyethylene terephthalate support in an amount of 3.0 g/m$^2$ as calculated in terms of amount of silver. At the same time, a gelatin protective layer was coated on the coat layer to prepare direct positive photographic light-sensitive material samples.

These samples were then exposed to light from 1-kW tungsten lamp heated at a color temperature of 2854° K. through a step wedge for 1 second. These samples were developed with a developing solution D made of a mixture of 1 l of replenishing solution A described below and 20 ml of Starter B described below at a temperature of 30° C. for 1 minute by means of an automatic developing machine (FMC P-4800 type camera processor: Fuji Photo Film Co., Ltd.). These samples were then subjected to stopping, fixing, rinsing, and drying in ordinary manners. These samples were measured for maximum density (Dmax) and sensitivity. The results are shown in Table 7.

| Replenishing Solution A | |
|---|---|
| Sodium sulfite | 100 g |
| Potassium carbonate | 20 g |
| 1-Phenyl-4-methyl-4-hydroxymethyl-3-pyrazolidone | 3 g |
| Hydroquinone | 45 g |
| 5-Methylbenzotriazole | 40 mg |
| Water to make | 1 liter |
| Potassium hydroxide to make pH | 11.2 |
| **Starter B** | |
| Sodium bromide | 175 g |

-continued

| | |
|---|---|
| Glacial acetic acid | 63 ml |
| Water to make | 1 liter |

TABLE 7

| No. | Nucleation*2 Accelerator | Dmax | Sensitivity*1 | Remarks |
|---|---|---|---|---|
| 1 | 1 | 2.82 | 100 | Present Invention |
| 2 | 3 | 2.85 | 100 | Present Invention |
| 3 | 8 | 2.80 | 104 | Present Invention |
| 4 | 28 | 2.79 | 101 | Present Invention |
| 5 | 43 | 2.75 | 102 | Present Invention |
| 6 | None | 2.12 | 100 | Comparative Example |

*1: The sensitivity is determined by the reciprocal of the exposure which provides a density of 1.5. The values shown are represented relative to that of sample No. 6 as 100
*2: Added amount: $4 \times 10^{-4}$ mol/mol of AgX Table 7 shows that the present sample Nos. 1 to 5 provide greater maximum positive image densities than comparative sample No. 6 and can be preferably used.

EXAMPLE 6

Samples were prepared in the same manner as in Example 5 except that Compound 50 was used as a nucleating agent and nucleation accelerators were used as shown in Table 8. These samples were then processed in the same manner as in Example 5 except that the development was conducted at a temperature of 32° C. These samples were measured for Dmax and sensitivity in the same manner as in Example 5. The results are shown in Table 8.

TABLE 8

| No. | Nucleation Accelerator | Dmax | Sensitivity | Remarks |
|---|---|---|---|---|
| 1 | 1 | 2.62 | 100 | Present Invention |
| 2 | 2 | 2.58 | 110 | Present Invention |
| 3 | 6 | 2.60 | 100 | Present Invention |
| 4 | 21 | 2.62 | 105 | Present Invention |
| 5 | 26 | 2.53 | 106 | Present Invention |
| 6 | 28 | 2.46 | 100 | Present Invention |
| 7 | 95 | 2.38 | 104 | Present Invention |
| 8 | 103 | 2.53 | 98 | Present Invention |
| 9 | 56 | 2.54 | 100 | Present Invention |
| 10 | None | 1.60 | 98 | Comparative Example |

The sensitivity was determined in terms of the reciprocal of the exposure which provides a density of 1.5. The values shown ar represented relative to that of sample No. 1 as 100. The added amount of the nucleation accelerators was the same as in Example 5.

The results in Table 8 show that the present sample Nos. 1 to 9 provide remarkably higher maximum positive image densities than the comparative sample No. 10.

EXAMPLE 7

Samples were prepared in the same manner as in Example 2 except that $2.5 \times 10^{-6}$ mol/mol Ag of Compounds 2, 3, 30, 21, 22, 24 or 26 was used as a nucleating agent in place of Compound 50 and $5.6 \times 10^{-5}$ mol/mol Ag of Compounds 40, 44, 52, 53, 54, 57 or 65 was used as a nucleation accelerator in place of those shown in Table 4. These samples were then processed and measured in the same manner as in Example 2. As a result, the samples exhibited excellent effects similarly to the samples obtained in Example 2.

In accordance with the present invention, direct positive images having a high maximum image density and a low minimum image density can be formed in a rapid and stable manner.

Furthermore, direct positive images less subject to generation of re-reversal negative images at a high intensity exposure can be obtained.

Furthermore, direct positive color images which are less susceptible to variation in the optimum value of the maximum image density and minimum image density when the temperature and pH of developing solution are varied and are less susceptible to variation in color reproducibility due to the similar variation when a color light-sensitive material is used, can be obtained.

Furthermore, direct positive images which are less susceptible to variation in the optimum value of the maximum image density and minimum image density and variation in gradation when the developing time is varied, can be obtained.

Furthermore, direct positive images can be obtained with a small reduction in maximum image density and no increase in minimum image density even when the light-sensitive material has been stored for a long period of time.

Furthermore, direct positive color images which are less susceptible to variation in color reproducibility when the developing time is varied can be obtained.

Moreover, in accordance with the present direct positive image formation process, the developing solution to be used is less susceptible to deterioration due to aerial oxidation. This provides a stabilized photographic property.

While the invention has been described in detail and with reference to specific embodiments thereof, it will be apparent to one skilled in the art that various changes and modifications can be made therein without departing from the spirit and scope thereof.

What is claimed is:

1. A process for the formation of direct positive color images which comprises (1) imagewise exposing to light a light-sensitive material comprising a photographic emulsion layer containing unfogged internal latent image type silver halide particles on at least one support, and (2) developing said light-sensitive material with a processing solution with a pH of 9.5 to 11.5 containing as a main component a p-phenylenediamine and in the presence of a nucleating agent and at least one nucleation accelerator of general formula (I):

$$A—Y)_nR]_m \quad (I)$$

wherein A represents a group which is adsorbed by a silver halide; Y represents a divalent linkage group consisting of a hydrogen atom, a carbon atom, a nitrogen atom, an oxygen atom, and a sulfur atom; R represents an organic group containing at least one of a thioether group, an amino group, an ammonium group, an ether group, and a heterocyclic group; n represents an integer of 0 or 1; and m represents an integer of 1 or 2, to form direct positive color images.

2. The process as claimed in claim 1, wherein said nucleation accelerator is represented by general formula (II):

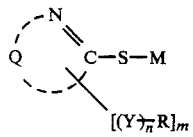

(II)

wherein Q represents an atomic group required to form a 5-membered or 6-membered heterocyclic ring which may be condensed with a carbon aromatic ring or heterocyclic aromatic ring; $\text{-}(Y)_nR]_m$ has the same meaning as defined in general formula (I); and M represents a hydrogen atom, an alkali metal atom, an ammonium group, or a group which undergoes cleavage under an alkali condition.

3. The process as claimed in claim 1, wherein said nucleation accelerator is represented by general formula (III):

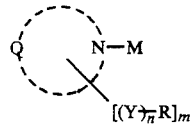

(III)

wherein Q and M each has the same meaning as defined in general formula (II); and $\text{-}(Y)_nR]_m$ has the same meaning as defined in general formula (I).

4. The process as claimed in claim 1, wherein said nucleating agent is a compound of general formula (N-1)

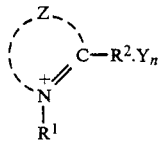

(N-I)

wherein Z represents a nonmetallic atomic group required to form a 5- or 6-membered hetero ring and may be substituted with substituents; $R^1$ represents an aliphatic group; $R^2$ represents a hydrogen atom, an aliphatic group, or an aromatic group; $R^1$ and $R^2$ each may be substituted with substituents; Y represents a counter ion for electric charge balance; n represents 0 or 1; with the proviso that at least one of $R^1$, $R^2$ and Z contains alkynyl groups, acyl groups, hydrazine groups, or hydrazone groups, or $R^1$ and $R^2$ together form a 6-membered ring, thereby forming a dihydropyridinium skeleton and that at least one of the substituents of $R^1$, $R^2$ and Z contains $X^1\text{-}(L^1)_m$ in which $X^1$ represents a group which accelerates adsorption by silver halide; and $L^1$ represents a divalent linkage group and m represents an integer of 0 or 1.

5. The process as claimed in claim 4, wherein $X^1$ is a thioamido group, a heterocyclic mercapto group or a nitrogen-containing heterocyclic ring which can form imino silver.

6. The process as claimed in claim 5, wherein the heterocyclic ring completed by Z is quinolinium, isoquinolinium, naphthopyridinium or benzothiazolium.

7. The process as claimed in claim 5, wherein the heterocyclic ring completed by Z is quinolinium.

8. The process as claimed in claim 5, wherein said at least one of $R^1$, $R^2$ and Z contains an alkynyl group.

9. The process as claimed in claim 8, wherein $R^1$ is a propargyl group.

10. The process as claimed in claim 5, wherein said thioamido group represented by $X^1$ is a thiourethane group and said heterocyclic mercapto group represented by $X^1$ is a mercaptotetrazolyl group.

11. The process as claimed in claim 5, wherein $R^1$ and $R^2$ combine to form a 6-membered ring.

12. The process as claimed in claim 1, wherein said nucleating agent is a compound of general formula (N-II)

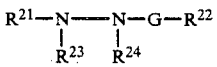

(N-II)

wherein $R^{21}$ represents an aliphatic group, an aromatic group, or a heterocyclic group; $R^{22}$ represents a hydrogen atom, an alkyl group, an aralkyl group, an aryl group, an alkoxy group, an aryloxy group, or an amino group; G represents a carbonyl group, a sulfonyl group, a sulfoxy group, a phosphoryl group, or an iminomethylene group (HN=C<); and $R^{23}$ and $R^{24}$ each represents a hydrogen atom, or one of $R^{23}$ and $R^{24}$ represents a hydrogen atom and the other represents any one of an alkylsulfonyl group, an arylsulfonyl group and an acyl group with the proviso that a hydrazone structure (>N—N=C<) containing G, $R^{23}$, $R^{24}$ and a hydrazine nitrogen may be formed.

13. The process as claimed in claim 12, wherein $R^{21}$ or $R^{22}$ has a group represented by $X^2$ which accelerates adsorption by silver halide.

14. The process as claimed in claim 12, wherein $X^2$ is a heterocyclic mercapto group or a nitrogen-containing heterocyclic ring which can form imino silver.

15. The process as claimed in claim 14, wherein the group represented by C—$R^{22}$ is a formyl group.

16. The process as claimed in claim 15, wherein $R^{23}$ and $R^{24}$ each are a hydrogen atom.

17. The process as claimed in claim 15, wherein $R^{21}$ is an aromatic group.

18. The process as claimed in claim 14, wherein the heterocyclic mercapto group represented by $X^2$ is a 5-mercaptotetrazolyl group or a 5-mercapto-1,2,4-triazolyl group.

19. The process as claimed in claim 1, wherein said nucleation accelerator is incorporated in the light-sensitive material or the processing solution.

20. The process as claimed in claim 19, wherein said nucleation accelerator is incorporated in the light-sensitive material.

21. The process as claimed in claim 19, wherein said nucleation accelerator is employed in an amount of $10^{-6}$ to $10^{-2}$ mol/mol of silver halide when such is incorporated in the light-sensitive material.

22. The process as claimed in claim 21, wherein said nucleation accelerator is employed in an amount of $10^{-5}$ to $10^{-2}$ mol/mol of silver halide when such is incorporated in the light-sensitive material.

23. The process as claimed in claim 19, wherein said nucleation accelerator is incorporated in the processing solution in an amount of from $10^{-7}$ to $10^{-3}$ mol/mol of processing solution.

24. The process as claimed in claim 23, wherein said nucleation accelerator is incorporated in the processing solution in an amount of from $10^{-7}$ to $10^{-4}$ mol/mol of processing solution.

25. The process as claimed in claim 1, wherein said nucleating agent is incorporated in said light-sensitive material or processing solution.

26. The process as claimed in claim 25, wherein said nucleating agent is employed in an amount of $10^{-8}$ to $10^{-2}$ mol/mol of silver halide when such is incorporated in the light-sensitive material.

27. The process as claimed in claim 26, wherein said nucleating agent is employed in an amount of $10^{-7}$ to $10^{-3}$ mol/mol of silver halide when such is incorporated in the light-sensitive material.

28. The process as claimed in claim 25, wherein said nucleating agent is incorporated in the processing solution in an amount of from $10^{-8}$ to $10^{-3}$ mol/liter of processing solution.

29. The process as claimed in claim 28, wherein said nucleating agent is incorporated in the processing solution in an amount of from $10^{-7}$ to $10^{-4}$ mol/liter of processing solution.

30. The process as claimed in the amended claim 1, wherein said p-phenylenediamine is selected from the group consisting of 3-methyl-4-amino-N,N-diethylaniline, 3-methyl-4-amino-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides, phosphates, p-toluene-sulfonates, tetraphenylborates, and p-(t-octyl)benzenesulfonates thereof.

31. The process as claimed in the amended claim 1, wherein said nucleation accelerator is represented by general formula (II):

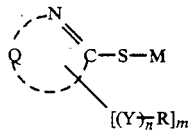

(II)

wherein Q represents an atomic group required to form a 5-membered or 6-membered heterocyclic ring which may be condensed with a carbon aromatic ring or heterocyclic aromatic ring; $\{(Y)_nR\}_m$ has the same meaning as defined in general formula (I); and M represents a hydrogen atom, an alkali metal atom, an ammonium group, or a group which undergoes cleavage under an alkali condition and wherein said nucleating agent is a compound of general formula (N-I)

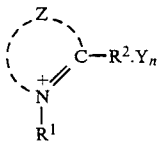

(N-I)

wherein Z represents a nonmetallic atomic group required to form a 5- or 6-membered hetero ring and may be substituted with substituents; $R^1$ represents an aliphatic group; $R^2$ represents a hydrogen atom, an aliphatic group, or an aromatic group; $R^1$ and $R^2$ each may be substituted with substituents; Y represents a counter ion for electric charge balance; n represents 0 or 1; with the proviso that at least one of $R^1$, $R^2$ and Z contains alkynyl groups, acyl groups, hydrazine groups, or hydrazone groups, or $R^1$ and $R^2$ together form a 6-membered ring, thereby forming a dihydropyridinium skeleton and that at least one of the substituents of $R^1$, $R^2$ and Z contains $X^1\{(L^1)_m$ in which $X^1$ represents a group which accelerates adsorption by silver halide; and $L^1$ represents a divalent linkage group and m represents an integer of 0 or 1.

32. The process as claimed in the amended claim 1, wherein said nucleation accelerator is represented by general formula (III):

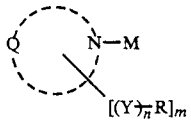

(III)

wherein Q and M each has the same meaning as defined in general formula (II); and $\{(Y)_nR\}_m$ has the same meaning as defined in general formula (I) and wherein said nucleating agent is a compound of general formula (N-I)

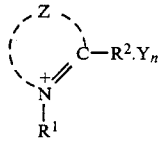

(N-I)

wherein Z represents a nonmetallic atomic group required to form a 5- or 6-membered hetero ring and may be substituted with substituents; $R^1$ represents an aliphatic group; $R^2$ represents a hydrogen atom, an aliphatic group, or an aromatic group; $R^1$ and $R^2$ each may be substituted with substituents; Y represents a counter ion for electric charge balance; n represents 0 or 1; with the proviso that at least one of $R^1$, $R^2$ and Z contains alkynyl groups, acyl groups, hydrazine groups, or hydrazone groups, or $R^1$ and $R^2$ together form a 6-membered ring, thereby forming a dihydropyridinium skeleton and that at least one of the substituents of $R^1$, $R^2$ and Z contains $X^1\{(L^1)_m$ in which $X^1$ represents a group which accelerates adsorption by silver halide; and $L^1$ represents a divalent linkage group and m represents an integer of 0 or 1.

* * * * *